US008573316B2

(12) United States Patent
Polan et al.

(10) Patent No.: US 8,573,316 B2
(45) Date of Patent: Nov. 5, 2013

(54) CONCEALED HORIZONTAL SIDEWALL SPRINKLER

(75) Inventors: George S. Polan, Liberty, SC (US); Oliver S. Pahila, Liberty, SC (US); Thomas L. Multer, Liberty, SC (US)

(73) Assignee: The Reliable Automatic Sprinkler Co., Inc., Liberty, SC (US)

( * ) Notice: Subject to any disclaimer, the term of this patent is extended or adjusted under 35 U.S.C. 154(b) by 624 days.

(21) Appl. No.: 12/871,859

(22) Filed: Aug. 30, 2010

(65) Prior Publication Data

US 2011/0030977 A1 Feb. 10, 2011

Related U.S. Application Data

(63) Continuation-in-part of application No. 10/974,397, filed on Oct. 26, 2004, now Pat. No. 7,784,555, and a continuation-in-part of application No. 11/848,103, filed on Aug. 30, 2007, now abandoned, which is a continuation of application No. 10/974,106, filed on Oct. 26, 2004, now Pat. No. 7,275,603.

(51) Int. Cl.
*A62C 37/08* (2006.01)

(52) U.S. Cl.
USPC ..... 169/38; 169/37

(58) Field of Classification Search
USPC ..... 239/37, 40, 42, 19, 16, 38, 39, 41
See application file for complete search history.

(56) References Cited

U.S. PATENT DOCUMENTS

| | | | | |
|---|---|---|---|---|
| 437,846 | A | 10/1890 | Kehr | 169/40 |
| 1,422,875 | A | 7/1922 | Madigan | 169/41 |
| 2,558,450 | A | 6/1951 | Martin | 169/37 |
| 3,714,989 | A | 2/1973 | Gloeckler | 169/19 |
| 4,014,388 | A | 3/1977 | Anderson | 169/37 |
| 4,105,076 | A | 8/1978 | Simons et al. | 169/40 |

(Continued)

FOREIGN PATENT DOCUMENTS

GB 2155328 A 9/1985

OTHER PUBLICATIONS

International Search Report from PCT Application No. PCT/US2011/049724, dated Jan. 19, 2012.

(Continued)

*Primary Examiner* — Davis Hwu
(74) *Attorney, Agent, or Firm* — Fitzpatrick, Cella, Harper & Scinto

(57) ABSTRACT

A horizontal sidewall fire protection sprinkler has a deflector having a vertical face, transverse to the fluid flow from the output orifice, and a horizontal shelf positioned above and perpendicular to the vertical face. A portion of the horizontal shelf extends in the fluid flow direction by a first length, with respect to the vertical face, and this first length is less than about half of the total length of the horizontal shelf in the fluid flow direction. The sprinkler may be installed in a support cup having a raised mounting platform configured to receive the sprinkler body and a cylindrical outer surface. A horizontal or pendent fire protection sprinkler has a body having an output orifice and a flange and a seal cap to seal a flow of fluid from the output orifice and a thermally-responsive element positioned to releasably retain the seal cap. Housing members extend through and from the flange of the sprinkler body, and contain rods, each of which extends through the flange. A deflector is connected to ends of the rods.

20 Claims, 22 Drawing Sheets

(56) References Cited

U.S. PATENT DOCUMENTS

| | | | | |
|---|---|---|---|---|
| 4,296,815 | A | 10/1981 | Mears | 169/37 |
| 4,296,816 | A | 10/1981 | Fischer | 169/37 |
| 4,491,182 | A | 1/1985 | Pieczykolan | 169/38 |
| 4,508,175 | A | 4/1985 | Pieczykolan | 169/38 |
| 4,618,002 | A | 10/1986 | Mears | 169/37 |
| 4,660,648 | A | 4/1987 | Zen | 169/38 |
| 4,662,455 | A | 5/1987 | Simons | 169/37 |
| 4,880,063 | A | 11/1989 | Leininger | 169/37 |
| 4,926,946 | A | 5/1990 | Polan | 169/37 |
| 4,938,292 | A | 7/1990 | Johnson | 169/19 |
| 4,976,320 | A | 12/1990 | Polan | 169/39 |
| 4,987,957 | A | 1/1991 | Galaszewski | 169/37 |
| 5,020,601 | A | 6/1991 | Retzloff et al. | 169/37 |
| 5,036,923 | A | 8/1991 | Shea | 169/37 |
| 5,080,176 | A | 1/1992 | Polan et al. | 169/37 |
| 5,083,616 | A | 1/1992 | Polan | 169/40 |
| 5,094,298 | A | 3/1992 | Polan | 169/41 |
| 5,097,906 | A | 3/1992 | Polan | 169/37 |
| 5,152,344 | A | 10/1992 | Fischer et al. | 169/37 |
| 5,234,059 | A | 8/1993 | Eynon | 169/39 |
| 5,299,645 | A | 4/1994 | Hoening et al. | 169/39 |
| 5,447,338 | A | 9/1995 | Kikuchi | 285/46 |
| 5,494,114 | A | 2/1996 | Hoening et al. | 169/38 |
| 5,664,630 | A | 9/1997 | Meyer et al. | 169/37 |
| 5,722,599 | A | 3/1998 | Fries | 239/504 |
| 5,727,737 | A | 3/1998 | Bosio et al. | 239/504 |
| 5,810,263 | A | 9/1998 | Tramm | 239/518 |
| 6,082,463 | A | 7/2000 | Ponte | 169/41 |
| 6,098,718 | A | 8/2000 | Sato | 169/37 |
| 6,123,153 | A | 9/2000 | Finnegan | 169/37 |
| 6,230,815 | B1 | 5/2001 | Sundholm | 169/37 |
| 6,296,062 | B1 | 10/2001 | Sundholm | 169/37 |
| 6,345,670 | B1 | 2/2002 | Sundholm | 169/37 |
| 6,374,919 | B1 | 4/2002 | Neill | 169/37 |
| 6,840,329 | B2 | 1/2005 | Kikuchi | 169/37 |
| 7,275,603 | B2 | 10/2007 | Polan | 169/37 |
| 7,353,882 | B2 * | 4/2008 | Pahila | 169/37 |
| 7,784,555 | B2 * | 8/2010 | Pahila | 169/37 |
| 2002/0088624 | A1 | 7/2002 | Waligorski | 169/38 |
| 2002/0129946 | A1 | 9/2002 | Retzloff et al. | 169/37 |
| 2002/0148620 | A1 | 10/2002 | Polan | 169/38 |
| 2003/0222155 | A1 | 12/2003 | Neil et al. | 239/208 |

OTHER PUBLICATIONS

"Series TY-L—5.6 K-Factor Horizontal Sidewall Sprinklers Standard Response, Standard Coverage," Tyco Fire Products, Lansdale, PA, Jan. 2003.

"Series TY-FRB—5.6 and 8.0 K-Factor Extended Coverage Horizontal Sidewall Sprinklers Quick & Standard Response (Light Hazard)." Tyco Fire Products, Lansdale, PA, Jan. 2003.

"Model SW-20 and SW-24—11.2 K-Factor Extended Coverage Ordinary Hazard Horizontal Sidewall Sprinklers (Standard Response)." Tyco Fire Products, Lansdale, PA, Apr. 2003.

"Model CHEC—8.0 K-Factor Concealed Horizontal Extended Coverage Quick Response Light Hazard, Sidewall Sprinklers." Tyco Fire Products, Lansdale, PA, Apr. 2004.

"Series LFII Residential Horizontal Sidewall Sprinklers 4.2 K-Factor." Tyco Fire Products, Lansdale, PA, Apr. 2004.

"Series LFII Residential Concealed Pendent Sprinkler, Flat Plate, 4.2 K-Factor." Tyco Fire Products, Lansdale, PA, Jul. 2002.

* cited by examiner

FIG. 26
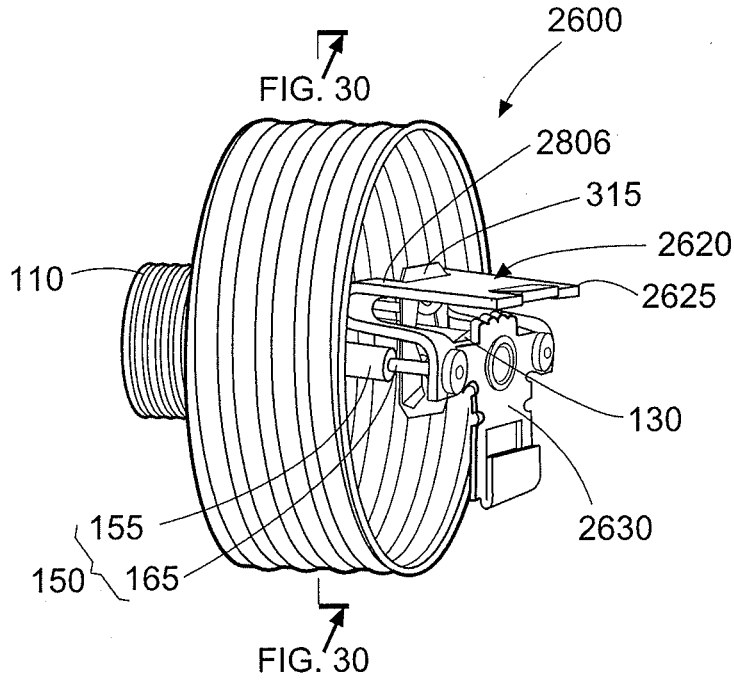
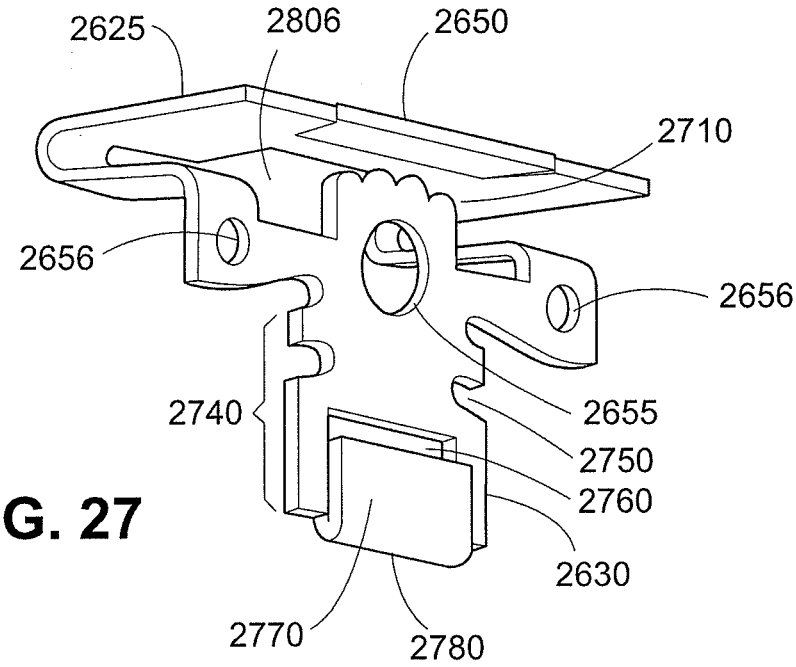
FIG. 27

CONCEALED HORIZONTAL SIDEWALL SPRINKLER

CROSS-REFERENCE TO RELATED APPLICATIONS

This application is a continuation-in-part of U.S. patent application Ser. No. 10/974,397, filed Oct. 26, 2004, and is a continuation-in-part of U.S. patent application Ser. No. 11/848,103, filed Aug. 30, 2007, which is a continuation of U.S. patent application Ser. No. 10/974,106, filed Oct. 26, 2004 (now U.S. Pat. No. 7,275,603), the entire contents of each of which are incorporated herein by reference.

BACKGROUND

1. Field of the Invention

The present invention relates to a pendent fire protection sprinkler with a drop-down deflector. The present invention further relates to concealed pendent sprinklers for residential applications. The present invention relates to horizontal sidewall fire protection sprinklers, including those having a deflector with a rearwardly positioned horizontal shelf, which reduces the overall length of the sprinkler to provide a low-profile configuration. Such sprinklers may also be mounted in a supporting cup having a raised platform, with an escutcheon and cover, to provide a concealed configuration with improved sensitivity.

2. Related Art

Fire protection sprinklers conventionally are connected to a conduit to receive pressurized fire-extinguishing fluid, such as water. A typical sprinkler has a base with a threaded portion for connection to the conduit and an output orifice to output the fluid to provide fire control and/or suppression. The output orifice is sealed by a seal cap, which is held in place by a release mechanism. The release mechanism is designed to release the cap under predetermined conditions, thereby initiating the flow of fire-extinguishing fluid. A typical release mechanism includes a thermally-responsive element, e.g., a frangible bulb or a fusible link, and may include a latching mechanism.

Fire protection sprinklers may be mounted on a fluid conduit running along a ceiling and may either depend downward from the conduit, which is referred to as a "pendent" configuration, or may extend upward, which is referred to as an "upright" configuration. Alternatively, a sprinkler may be mounted on a wall, a certain distance below the ceiling, which is referred to as a "horizontal sidewall" configuration. Horizontal sidewall sprinklers have an output orifice that is oriented so that the fluid is output horizontally and sprays onto an area to be protected in front of the sprinkler. The area to be protected may extend across an entire room, in which case the relevant fire protection standards, e.g., Underwriters' Laboratories® Standard 1626, require the fluid flow to reach a particular height on the four walls surrounding the coverage area, among other requirements. Horizontal sidewall sprinklers are particularly useful in applications in which overhead piping is not easily installed, e.g., in residential applications.

Certain conventional sprinklers have a pair of arms that extend from a base, with the arms connecting at a hub. The hub is spaced apart from the output orifice of the base and is aligned with a longitudinal axis thereof. The hub may have a set-screw configured to apply a force to the thermally-responsive element and latching mechanism to maintain the seal cap in a position in which it seals the output orifice. A deflector is commonly provided, and may be mounted on the hub, transverse to the output orifice, to provide dispersion of the output fluid.

Other sprinklers have a deflector that is attached by a pair of arms that extend from the base of the sprinkler, but do not meet at a hub. In such sprinklers, the thermally-responsive element holds the seal cap in place without being held in compression by a hub. For example, U.S. Pat. No. 4,976,320 shows a sprinkler having a deflector attached to the body with arms that do not meet at a hub. The arms extend from the sprinkler body, and a drop-down deflector is attached to the sprinkler via two guide pins, which are installed in holes in a bent portion at the bottom of each arm. U.S. Pat. No. 5,664,630 shows another example of a sprinkler with a drop-down deflector.

U.S. Pat. No. 6,374,919 shows a horizontal sidewall sprinkler having a deflector with a horizontal shelf. The forwardly-extended portion of the shelf (approximately 0.6 inch) is greater than half the total length (approximately 1.0 inch) thereof. The sprinkler is mounted in a cup with a cover. The cup is mounted in a cavity in the wall such that the flange of the cup is flush with the wall surface. A cover is mounted on the flange so as to leave a gap therebetween to allow air flow to enter.

Technical bulletin "Series LFII Residential Horizontal Sidewall Sprinklers 4.2 K-factor" (Tyco Fire Products, Lansdale, Pa., April 2004) shows a horizontal sidewall sprinkler having a deflector with a horizontal shelf. The shelf is perpendicular to the frame arms and is approximately 0.7 inch in length, as measured from front edge to back edge near the center (the front edge faces away from the output orifice). The shelf appears to extend at a slightly upward angle with respect to the horizontal axis and has a protrusion in the center of the forward edge. The shelf extends approximately 0.43 inch beyond the major vertical surface of the deflector (i.e., the surface transverse to the fluid flow). Thus, the forwardly-extended portion of the shelf is approximately 61% of the total length thereof.

Technical bulletin "Series TY-L-5.6 K-factor Horizontal Sidewall Sprinklers, Standard Response, Standard Coverage" (Tyco Fire Products, Lansdale, Pa., January 2003) shows a horizontal sidewall sprinkler having a deflector with a horizontal shelf. The shelf is parallel to the frame arms and is approximately 0.66 inch in length, as measured from front edge to back edge near the center (the front edge facing away from the output orifice). The shelf extends approximately 0.37 inch beyond the major vertical surface of the deflector (i.e., the surface transverse to the fluid flow). Thus, the forwardly-extended portion of the shelf is approximately 56% of the total length thereof.

Technical bulletin "Model CHEC-8.0 K-factor Concealed Horizontal Extended Coverage Quick Response Light Hazard, Sidewall Sprinklers" (Tyco Fire Products, Lansdale, Pa., April 2004) shows a horizontal sidewall sprinkler having a deflector with a horizontal shelf. The shelf is perpendicular to the frame arms and is approximately 0.880 inch in length, as measured from front edge to back edge near the center (the front edge facing away from the output orifice). The shelf has a protrusion in the center of the forward edge. The shelf extends approximately 0.56 inch beyond the major vertical surface of the deflector (i.e., the surface transverse to the fluid flow). Thus, the forwardly-extended portion of the shelf is approximately 63.6% of the total length thereof. This document also shows the sprinkler mounted in a support cup assembly with a cover. The sprinkler is positioned in the support cup such that a frangible glass bulb is completely enclosed within the support cup and does not extend beyond the wall surface (i.e., the "retainer flange mounting surface"). The hub at which the frame arms meet is positioned so that a portion of the hub falls within the gap between the flange and the cover (i.e., within the "preset gap).

Some conventional horizontal sidewall sprinklers are installed in such a manner that their structure is visible, which is not aesthetically pleasing. Moreover, the sprinkler's extending structure tends to invite improper use of the sprinkler, for example to hang clothing or other items. Such improper use is undesirable, as it may render the sprinkler inoperable or cause unintended activation. Some conventional horizontal sidewall sprinklers are mounted in a support cup with a cover, such that the thermally-responsive element is positioned completely within the support cup. This arrangement tends to reduce air flow across the thermally-responsive element and correspondingly reduces the sensitivity of the sprinkler. Moreover, such configurations often include deflector shelves that extend significantly beyond the vertical surface of the deflector and require covers that extend further from the wall.

SUMMARY OF THE INVENTION

In one aspect, the present invention provides a fire protection sprinkler, including a body having an output orifice and a flange, a seal cap to seal a flow of fluid from the output orifice, and a thermally-responsive element positioned to releasably retain the seal cap. Housing members extend from the flange, and rods are slidably contained within the housing members and extend into the flange. A deflector is connected to ends of the rods.

Embodiments of the present invention may include one or more of the following features. The thermally-responsive element may include a pair of levers, each of which is connected to a plate of a soldered link. The rods may slide between a first position within the housing member, to a second, lower position extending from the housing member. In the second position, the rods may engage the housing members so as to assist in maintaining the deflector in a relatively stable position. Each of the rods may have at least one cylindrical portion and at least one frustoconical portion. Each of the housing members also may have at least one cylindrical portion and at least one frustoconical portion. The frustoconical portion of the rod may lodge in a frustoconical portion of the housing member.

The deflector may include a conical portion facing the output orifice and radial slots. At least two sides of the deflector may be substantially linear. The deflector may include tab portions with holes configured to receive ends of the rods, to connect the deflector to the rods.

Embodiments may further include a support cup having a substantially cylindrical outer surface, with the sprinkler mounted in the support cup. The height of the outer surface of the support cup in an axial direction may be less than that of the rods. A substantially cylindrical escutcheon having a flange may be installed in the support cup so as to surround the sprinkler. A substantially flat cover may be releasably mounted on the flange of the escutcheon. The deflector may move from a first position to a second, lower position upon release of the cover.

In another aspect, the present invention provides a fire protection sprinkler, including a body having an output orifice and a flange, a seal cap to seal a flow of fluid from the output orifice, and a thermally-responsive element positioned to releasably retain the seal cap. The sprinkler further includes deflector support members extending from the flange and a deflector connected to the deflector support members. In embodiments of this aspect, the deflector support members may extend through the flange.

In another aspect, the present invention provides a fire protection sprinkler, including a body having an output orifice and a flange, a seal cap to seal a flow of fluid from the output orifice, and a thermally-responsive element positioned to releasably retain the seal cap. The sprinkler further includes deflector support members having movable portions configured to move from a first position to a second position. A deflector is connected to the movable portions of the deflector support members. In the first position, the movable portions of the deflector support members are within the flange, and in the second position, the movable portions of the deflector support members are in a lower position, below the flange.

In another aspect, the present invention provides a horizontal sidewall fire protection sprinkler including a body having an output orifice, a seal cap to seal a flow of fluid from the output orifice, and a thermally-responsive element positioned to releasably retain the seal cap. The sprinkler also includes a deflector having a substantially vertical face that is transverse to a direction of fluid flow from the output orifice, and a substantially horizontal shelf positioned above and substantially perpendicular to the vertical face. A portion of the horizontal shelf extends in the direction of fluid flow by a first length, with respect to the vertical face, and this first length is less than about half of a total length of the horizontal shelf in the fluid flow direction.

Embodiments of the present invention may include one or more of the following features. The first length may be about 35% or less of the total length of the horizontal shelf. The horizontal shelf may include an inclined portion on a forward edge thereof, which may extend across a majority of a width of the horizontal shelf. The inclined portion may be substantially planar.

The vertical face of the deflector may have notches that are oriented about an opening formed in the deflector, between the vertical face and an underside of the horizontal shelf. The vertical face of the deflector may include a folded portion at a bottom edge thereof. The folded portion may form an angle, possibly of about 2°, with respect to the vertical face. The vertical face of the deflector may have a substantially rectangular opening near a bottom edge thereof.

The horizontal sidewall fire protection sprinkler also may include a support cup having a substantially cylindrical outer surface, a front edge in the direction of fluid flow, and a back edge. The support cup may have a raised mounting platform in which the body is mounted. The mounting platform may be closer to the front edge of the support cup in an axial direction thereof than to the back edge. A distance between the mounting platform and the back edge of the support cup in the axial direction may be at least about twice a distance between the mounting platform and the front edge of the support cup. The sprinkler also may include an escutcheon having a substantially cylindrical outer surface configured to fit inside the outer surface of the support cup. A cover may be attached to a mounting flange of the escutcheon.

In other embodiments, the sprinkler may include a support cup in which the sprinkler body is mounted. The support cup may have an outer surface configured to be positioned within a cavity in a wall, and an escutcheon with an outer surface configured to fit inside the outer surface of the support cup and a flange on a front edge of the outer surface (the flange being configured to mount against a surface of the wall).

In another aspect, the present invention provides a fire protection sprinkler including a body with an output orifice sealed with a seal cap, a thermally-responsive element positioned to releasably retain the seal cap, and a deflector positioned a distance from the output orifice in a direction of fluid flow. The sprinkler further includes a support cup having a raised mounting platform configured to receive the body. The support cup has a substantially cylindrical outer surface, a front edge in the fluid flow direction, and a back edge. The mounting platform is closer to the front edge of the support cup in an axial direction thereof than to the back edge of the support cup.

Embodiments of the present invention may include one or more of the following features. An escutcheon may be provided having a substantially cylindrical outer surface configured to fit inside the outer surface of the support cup. A cover may be attached to a mounting flange of the escutcheon. A distance between the mounting platform and the back edge of the support cup in the axial direction may be at least about twice a distance between the mounting platform and the front edge of the support cup.

In yet another aspect, the present invention provides a horizontal sidewall sprinkler that includes a body having an output orifice and a flange, the body having an axis in an output direction. The sprinkler also includes a seal cap to seal a flow of fluid from the output orifice, and a thermally-responsive element positioned to releasably retain the seal cap at a first predetermined temperature. The sprinkler further includes a plurality of housing members extending from the flange and a plurality of rods, each rod slidably contained within one of the housing members and extending into the flange. The sprinkler also includes a deflector connected to ends of the rods. The deflector includes a first surface extending in a direction transverse to the rods and a second surface connected to the first surface extending in a direction parallel to a plane passing through the rods. Each of the rods comprises at least one cylindrical portion and at least one frustoconical portion, and each of the housing members comprises at least one cylindrical portion and at least one frustoconical portion, and at least one frustoconical portion of the rod lodges in at least one frustoconical portion of the housing member.

These and other objects, features and advantages will be apparent from the following description of the preferred embodiments of the present invention.

BRIEF DESCRIPTION OF THE DRAWINGS

The present invention will be more readily understood from a detailed description of the preferred embodiments taken in conjunction with the following figures.

FIG. 26 is an isometric view of a horizontal sidewall fire protection sprinkler of the present invention.

FIG. 27 is an isometric view of the horizontal sidewall sprinkler deflector of FIG. 26.

DETAILED DESCRIPTION

Figure 1:
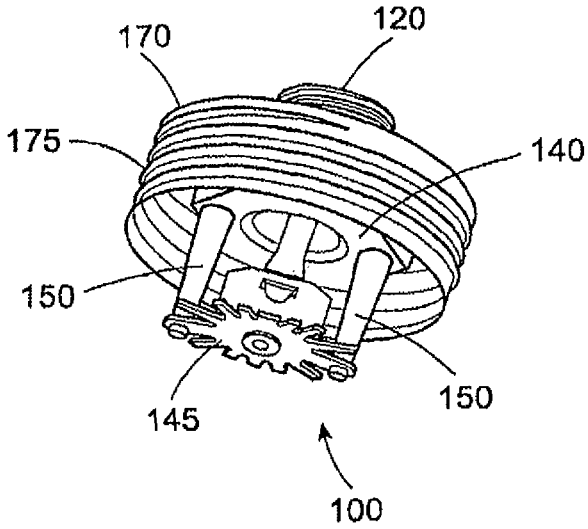
FIG. 1 is an isometric view of a pendent fire protection sprinkler according to one preferred embodiment.
Figure 2:
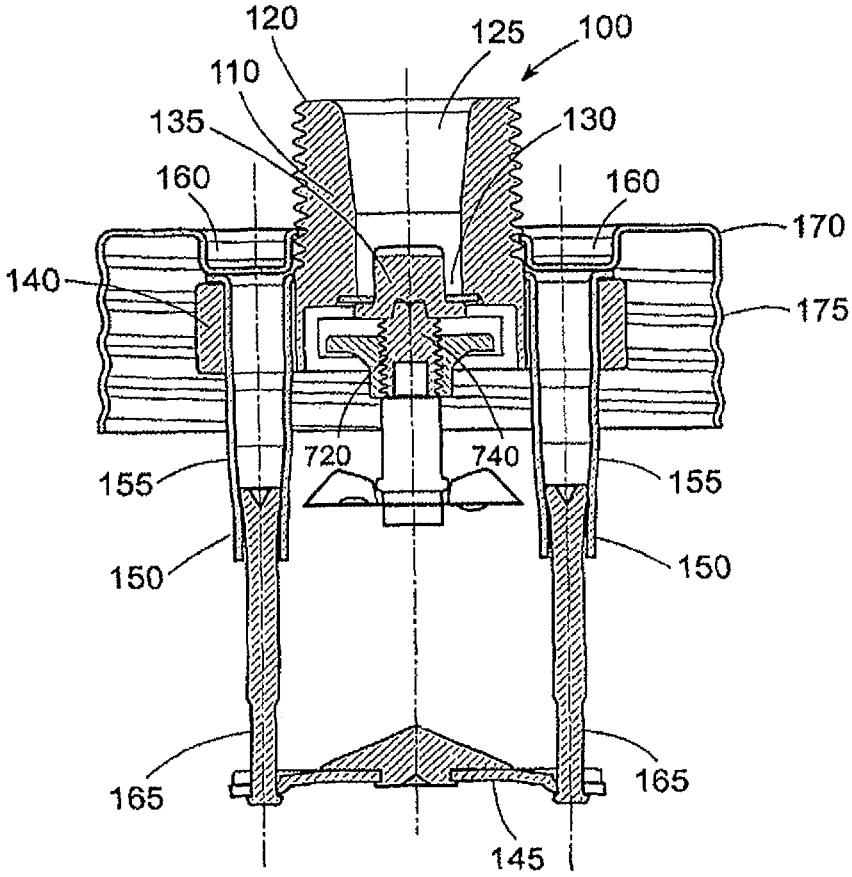
FIG. 2 is a sectional view of the sprinkler installed in the support cup, with the deflector in the deployed position.

As shown in FIGS. 1 and 2, a pendent fire protection sprinkler 100 in accordance with the present invention has a body 110 with a threaded base 120 for connection to a conduit (not shown) for supplying pressurized fire-extinguishing fluid, such as water. The body 110 has an axial bore 125 with an outlet orifice 130 from which the fluid is output upon release of a seal cap 135. The output orifice 130 may have a diameter of, for example, ⅜ or 7/16 inch. The sprinkler may have a nominal K-factor of, for example, 4.3 or 5.6, respectively, which is defined by $K=Q/\sqrt{p}$, where Q is the flow rate in gallons per minute and p is the residual pressure at the inlet of the sprinkler in pounds per square inch. The body 110 also has a hexagonal flange 140 around its output end. Of course in other embodiments, the flange 140 may have other shapes, including, for example, a rectangle and a diamond shape.

A deflector 145 is coupled to two deflector support members 150 on opposite sides of the sprinkler body 110. Each of the support members 150 includes a housing member 155, which extends downward from the flange 140 of the sprinkler body 110, and a rod 165, which is movable with respect to the housing member 155.

Figure 8:
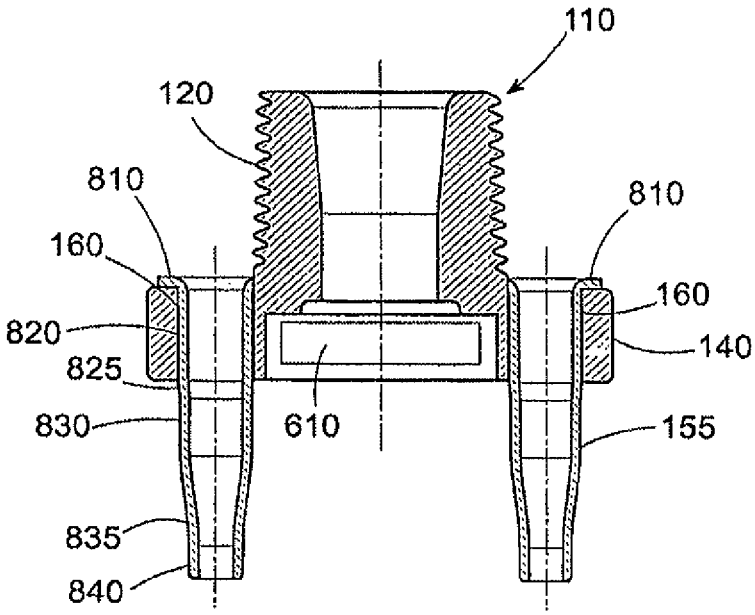
FIG. 8 is a sectional view of the sprinkler body showing the housing members of the deflector support members.
Figure 9:
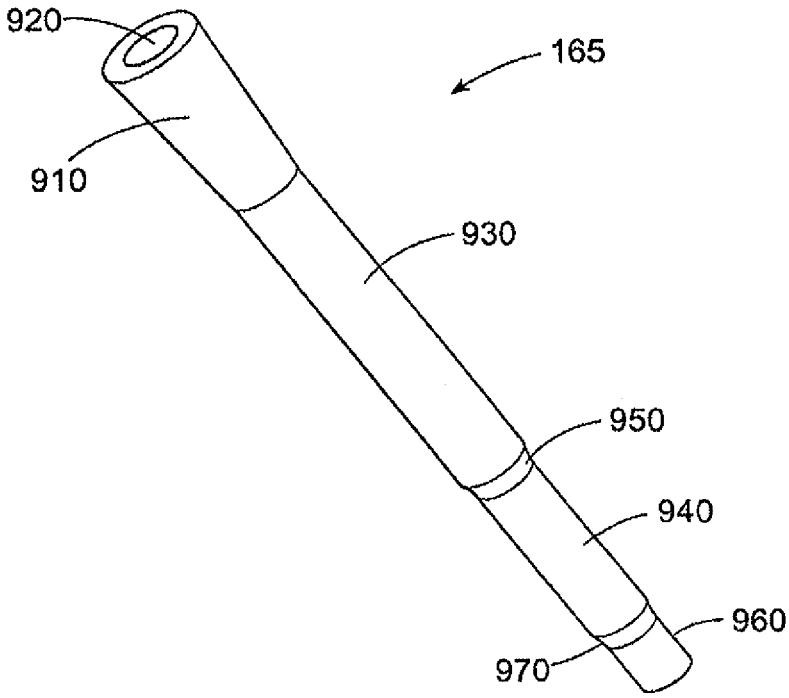
FIG. 9 is an isometric view of a rod that forms part of the deflector support member.

For example, the housing member 155 may be a tubular structure positioned within and extending downward from a hole 160 in the flange 140, and the rod 165 may be a solid, generally cylindrical member contained within the housing member 155. However, numerous other configurations for the housing members 155 and rods 165 also are possible. For example, the rods 165 may be tubular members, rather than solid members. Although the configuration of the preferred embodiment of the housing members 155 and rods 165 are shown in FIGS. 8 and 9, other shapes are possible as well, e.g., square, hexagonal, cylindrical, telescopic, etc. In addition, although in the preferred embodiment the flange 140 and housing members 155 are separate components, the present invention is not so limited, and those components may be configured as a unitary structure or having multiple components.

During operation, the rods 165 slide from an initial position, in which a large portion of the length of the rod 165 is within the housing member 155 (as shown in FIG. 1) to a deployed position, in which a substantial portion of the length of the rod 165 extends from the bottom of the housing member 155 (as shown in FIG. 2). Accordingly, in the deployed position, the deflector 145 moves downward along with the rods 165 (see FIG. 2).

The sprinkler 100 is mounted in a support cup 170 having a cylindrical, threaded outer wall 175, which surrounds a portion of the installed sprinkler 100 and, as discussed below, allows for installation into a ceiling cavity. The support cup 170 also has a mounting platform 305 (see FIG. 3) with a hole in the center into which the sprinkler body 100 is inserted. The hole has a threaded rim portion 310 or tabs configured to interlock with the threads of the sprinkler base 120.

Figure 3:
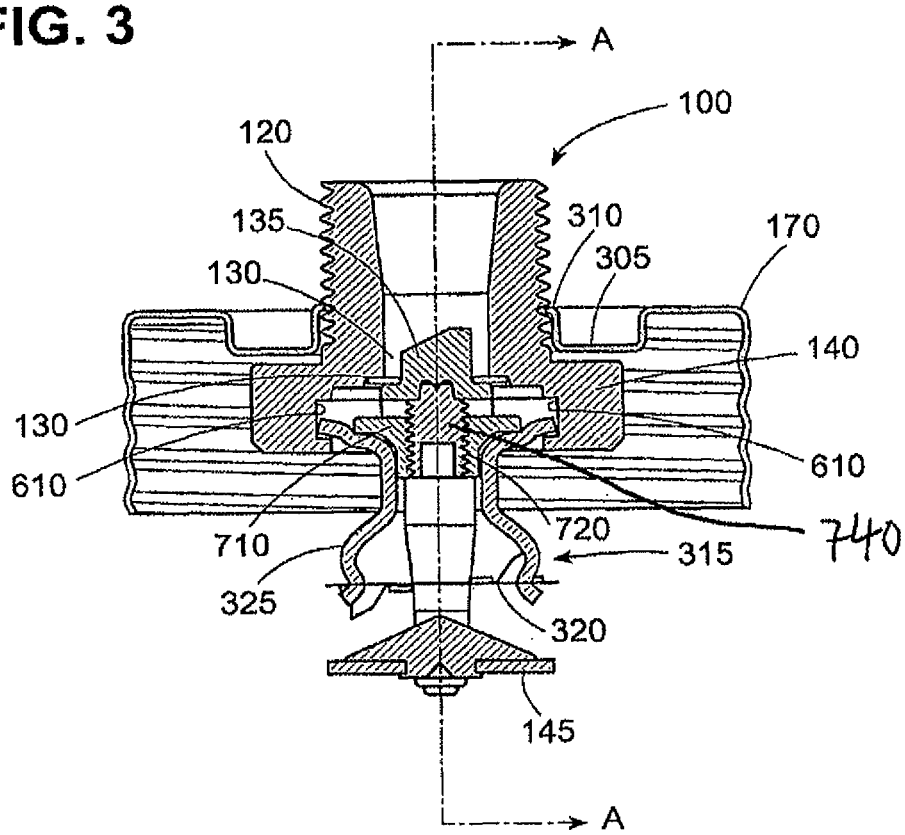
FIG. 3 is a sectional view of the sprinkler and support cup, showing the levers and fusible link.
Figure 4:
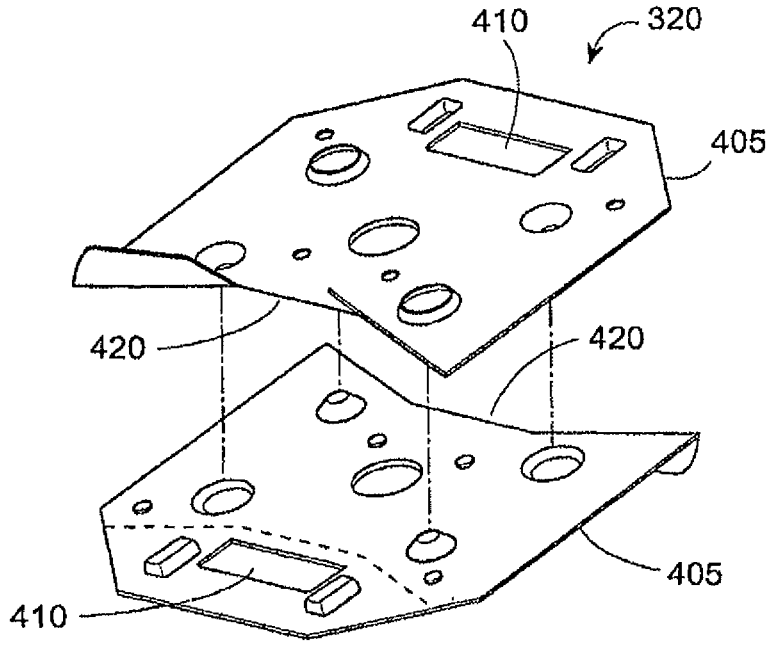
FIG. 4 is an isometric view of the fusible link.

As shown in FIG. 3, the sprinkler also has a thermally-responsive element 315 that holds the seal cap 135 in place over the output orifice 130, e.g., a fusible soldered link 320 attached to the ends of two levers 325. As shown in FIG. 4, the link 320 comprises two thin, metal plates 405, e.g., beryllium-nickel alloy. The metal plates 405 may also be formed of a nickel alloy. The plates 405 overlap such that a rectangular opening 410 in each plate 405, in which the ends of the levers 325 are positioned, is aligned with a slot 420 or open portion in the other plate 405. The plates 405 are attached with solder that melts at a predetermined temperature. The link 320 separates at the predetermined temperature, due to the force applied by the levers 325, allowing the levers 325 to swing outward (FIG. 3). This in turn releases the seal cap 135 and allows the fluid to be output from the orifice 130. Of course, other types of thermally-responsive elements may be used, including, but not limited to, for example, a frangible bulb and lever assembly, or a sensor, strut, and lever assembly.

Figure 5:
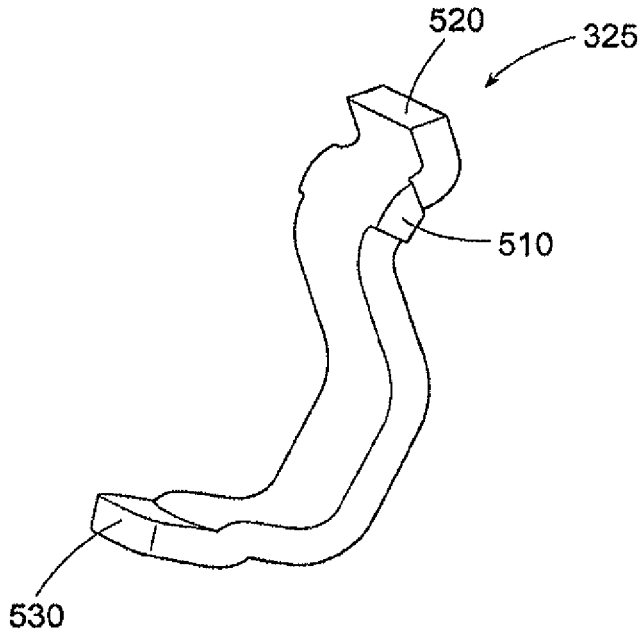
FIG. 5 is an isometric view of a lever.
Figure 6:
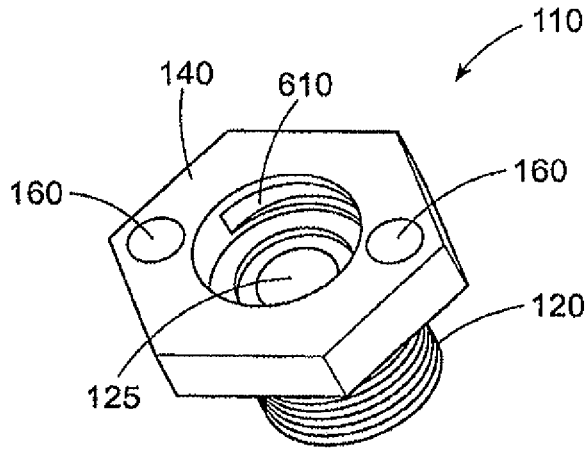
FIG. 6 is an isometric view of the underside of the sprinkler body showing part of an outlet orifice.

Each lever, as shown in FIG. 5, is an elongated, thin, metal member, e.g., copper alloy with a thickness of 0.050 inch. Each lever 325 has a wider tab portion 510 located near the end 520 that inserts into one of the openings 410 in the link plates 405. The tab portion 510 rests against the plates 405, so as to maintain the position of the lever 325 with respect to the plates 405. The other end 530 of each lever 325 is inserted into one of a pair of arcuate, rectangular slots 610, as shown in FIG. 6, formed inside the bore 125 on either side of the outlet orifice. The slots 610 are positioned 90° apart from the deflector support members 150 in the plane of the flange 140.

Figure 7:
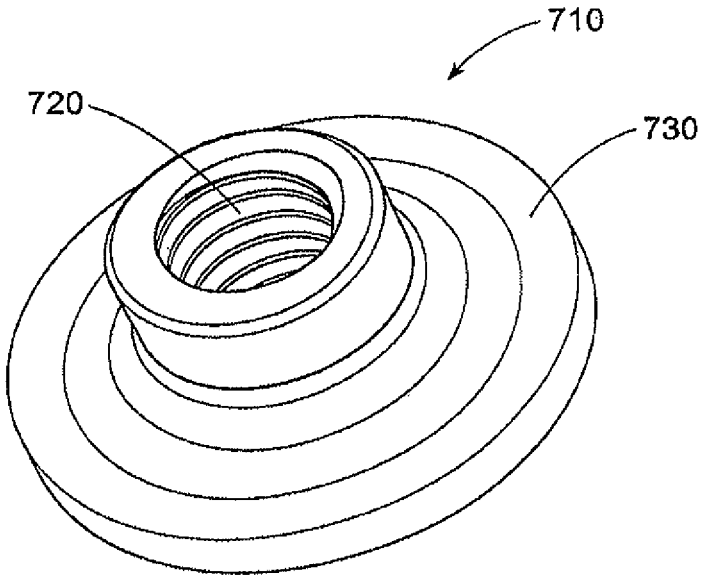
FIG. 7 is an isometric view of the load yoke.

Referring again to FIG. 3, the levers 325 swing outward upon release of the fusible link 320 due to the force of the fluid in the conduit against the seal cap 135 and a pre-tension force supplied by a loading yoke 710, as shown in FIG. 7. The loading yoke 710 is a cylindrical member with a threaded bore 720 and a circumferential flange 730 at one end. A load screw 740 (see FIG. 3) extends completely through the bore 720 of the yoke 710 and rests in an indentation in the seal cap 135. The yoke 710 is forced against the levers 325 by the tightening of the load screw 740 against the seal cap 135, thereby forcing the levers 325 away from one another.

As shown in the cross-sectional view of FIG. 8, the housing members 155 of the deflector support members 150 are positioned in through-holes 160 formed in the flange 140 of the sprinkler body 110, such that their axes are spaced apart by about 1.125 inches (in this embodiment). Each housing member 155 is about 1.13 inches in length and is formed of thin metal, e.g., copper alloy. The top end of each housing member 155 has a flange 810 to hold it in place. The outer perimeter of this flange 810 is circular, with a cutout to allow the housing member 155 to be positioned closer to the sprinkler body 110.

At the top of each housing member 155 (i.e., the flanged end) is a first cylindrical portion 820, which is about 0.35 inch in length and about 0.26 inch in diameter. This is followed by a first frustoconical portion 825 having a length of 0.08 inch and forming an angle of about 8.0° with respect to the longitudinal axis of the housing member. A second cylindrical portion 830 adjoins, with a diameter of about 0.25 inch and a length of 0.20 inch. This is followed by a second frustoconical portion 835 having a length of 0.35 inch and forming an angle of about 8.6° with respect to the axis of the housing member. A third cylindrical portion 840 is provided at the end of the housing member 155, which has a length of about 0.11 inch and a diameter of about 0.2 inch. While these dimensions are present in this embodiment, it is within the reach of ordinary skill to make a sprinkler that would operate satisfactorily with values that depart somewhat from these, and to make a sprinkler that would be operable without using these exemplary values.

As shown in FIG. 9, the rods 165 of the deflector support members 150, which slide between a position within the housing members 155 and an extended position, are each about 1.28 inches in length. Each rod 165 has a frustoconical portion 910 at the top, which is about 0.29 inch in length and forms an angle of about 4.5° with respect to the longitudinal axis of the rod. The diameter of the frustoconical portion 910 is about 0.155 inch at the top end and about 0.11 inch at the bottom end. While these dimensions are present in this embodiment, it is within the reach of ordinary skill to make a sprinkler that would operate satisfactorily with values that depart somewhat from these, and to make a sprinkler that would be operable without using these exemplary values A conical void 920, which has a length of about 0.07 inch, an opening diameter of about 0.085 inch is formed in the end of the rod 165. The conical void 920 aids in material flow during the formation of the frustoconical portion 910 of the rod 165. The frustoconical portion 910 helps hold the rod 165 in rigid position at the bottom of the housing member 155 in the deployed position. While in the preferred embodiment the rod has a void in an end thereof, the present invention is not limited to this configuration and may include solid rods without a void or indentation, or hollow rods.

The frustoconical portion 910 is followed by a first cylindrical portion 930 of about 0.56 inch in length and a diameter of about 0.11 inch. A second cylindrical portion 940 of about 0.30 inch in length and about 0.093 inch in diameter is formed, and the top end of this portion blended to the surface of the first cylindrical portion by a curved surface 950 having a radius of 0.08 inch. A third cylindrical portion 960 having a length of about 0.115 inch and a diameter of about 0.082 inch is formed at the bottom of the rod 165. The surface of the third cylindrical portion 960 is blended to the surface of the second cylindrical portion 940 by a curved surface 970 having a radius of about 0.08 inch. While these dimensions are present in this embodiment, it is within the reach of ordinary skill to make a sprinkler that would operate satisfactorily with values that depart somewhat from these, and to make a sprinkler that would be operable without using these exemplary values.

When the sprinkler is deployed (see FIG. 2), the first frustoconical portion 910 of the rod 165 lodges in the second frustoconical portion 835 and third cylindrical portion 840 of the housing member. By using the above described configuration, the deflector is more stable when deployed, allowing for a consistent sprinkler spray pattern. By contrast, without such a configuration, the force of the fluid output may cause the deflector to wobble or shift to, and possibly jam in, an askew position, resulting in an undesirable spray pattern.

The stability of this configuration is in part attributed to the resiliency in the first frustoconical portion 910 of the rod 165, which provides a substantially locking fit between the rod 165 and the housing member 155. This in turn provides stability to the deployed deflector 145 when it is exposed to the stream of output fluid, thereby preventing undesirable vibration or movement of the deflector 145. While this is the preferred embodiment, the invention is not limited to this particular configuration, and may include other deflector support members.

Figure 10:
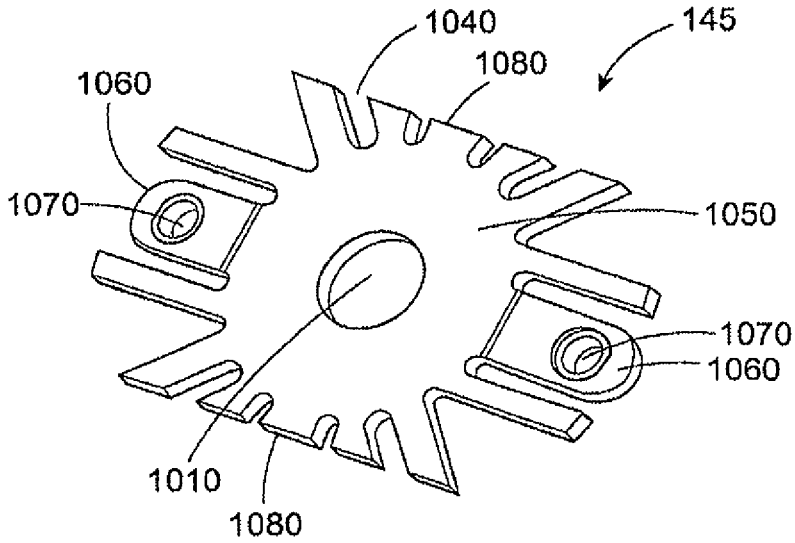
FIG. 10 is an isometric view of the deflector.
Figure 11:
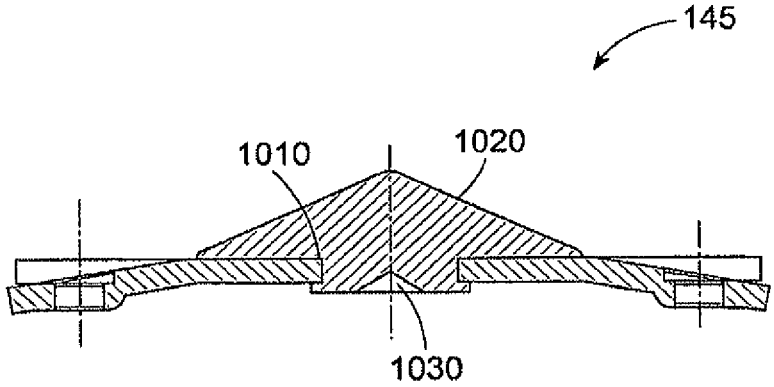
FIG. 11 is a sectional view of the deflector and the conical member.

The deflector 145, which is shown in detail in FIGS. 10 and 11, has an opening 1010 in the middle that is configured to receive a conical member 1020. The conical member 1020, which has an outer diameter of 0.7 inch and an included angle of 130°, faces the output orifice 130 to assist in the dispersion of the output fluid and to improve the stability of the deployed deflector 145. A conical indentation 1030 having an included angle of about 118° to about 120° is formed in the base of the conical member 1020 (which has a diameter of 0.245 inch) to allow it to achieve a secure press fit in the opening 1010 of the deflector 145. While these dimensions are present in this embodiment, it is within the reach of ordinary skill to make a sprinkler that would operate satisfactorily with values that depart somewhat from these, and to make a sprinkler that would be operable without using these exemplary values. The conical member 1020 also helps prevent the seal cap 135 and other ejected components from becoming lodged behind the deflector 145 upon deployment of the sprinkler.

The deflector 145 has radial slots 1040 around the perimeter thereof, arrayed around the opening 1010 for the conical member 1020. The slots 1040 extend inward to within a distance of the opening 1010 to form a generally circular central portion 1050 of the deflector 145 surface. Two tab portions 1060 extend from the sides of the deflector 145 with a downward angle of about 10° (with respect to the plane of the deflector) to provide mounting holes 1070 for the rods 165 extending from the deflector support members 150. The outer edges 1080 of the other two sides of the deflector are linear (see FIG. 10).

Figure 12:
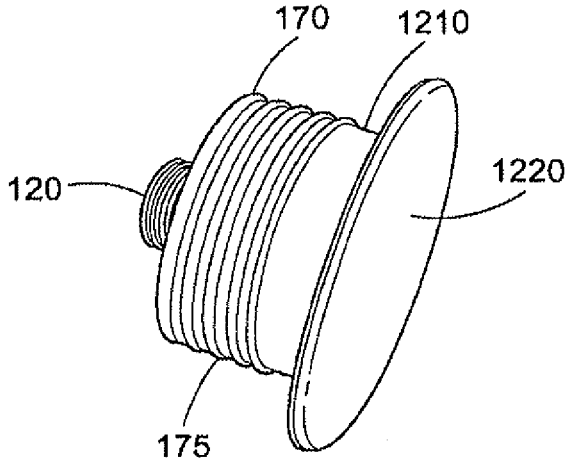
FIG. 12 is an isometric view of the sprinkler installed in the support cup, escutcheon, and cover assembly.
Figure 13:
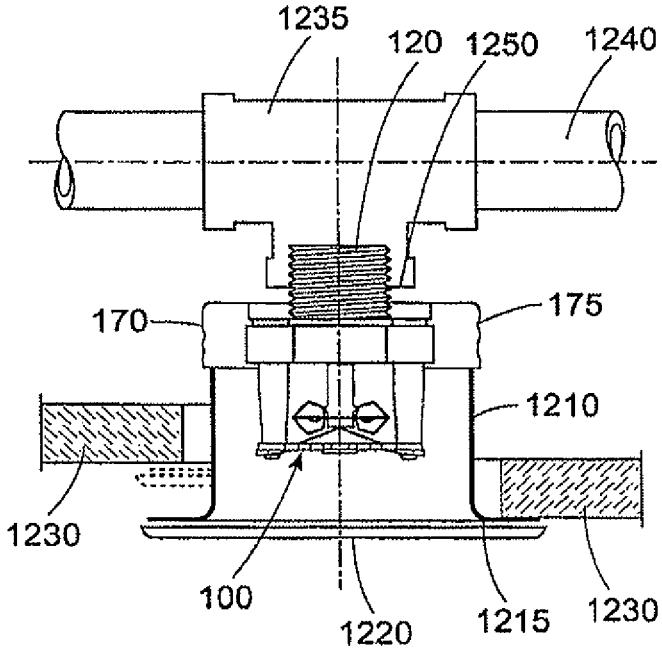
FIG. 13 is a sectional view of the sprinkler installed in a ceiling.

As shown in FIGS. 12 and 13, the sprinkler 100 installs within a support cup 170, escutcheon 1210, and cover 1220 assembly to form a concealed configuration. Such a configuration is particularly desirable for residential application due to its low profile and aesthetically pleasing appearance. The escutcheon 1210, which is cylindrical and has a circumferential flange 1215 on its outwardly facing end, installs with a press or threaded fit into the ridged outer surface (walls 175) of the support cup 170. The escutcheon 1210 is formed of metal, e.g., copper alloy.

A flat, circular cover 1220, which also is formed of metal, e.g., brass, is mounted on raised portions around the periphery of the escutcheon flange 1215 (see FIG. 13). The cover 1220 attaches to these raised portions with solder that is designed to melt at a predetermined temperature, e.g., 135° F., to allow for release of the cover 1220. The raised portions result in a gap between the cover 1220 and the escutcheon 1210, which allows air flow to reach the sprinkler 100. The release of the cover 1220 allows the deflector 145 to drop down into the deployed position. At a second predetermined temperature, e.g., 165° F., the fusible soldered link 320 separates, as described above, to initiate the flow of fluid from the sprinkler.

To install the sprinkler, the support cup 170, which has a diameter of, e.g., 2.28 inches, is inserted in a cavity in the ceiling 1230 having a diameter of, e.g., about 2⅝ inches, and the threaded base 120 of the sprinkler is connected to the output fitting 1235 of a conduit 1240. The escutcheon 1210 and cover 1220 assembly is then installed in the support cup 170 so that the escutcheon flange 1215 rests on the outer surface of the ceiling 1230 (the outer surface of the cover is about 3/16 inch from the surface of the ceiling due to the gap between the flange and cover). While these dimensions are present in this embodiment, it is within the reach of ordinary skill to make a sprinkler that would operate satisfactorily with values that depart somewhat from these, and to make a sprinkler that would be operable without using these exemplary values.

The support cup 170 and escutcheon 1210 are configured to allow for an adjustment to accommodate variations in the distance between the face 1250 of the conduit output fitting 1235 and the surface of the ceiling 1230, which is referred to as the "field adjustment." The field adjustment is sometimes needed, because the deflector 145 must be properly located below the ceiling 1230 in its deployed position, but it is difficult to precisely position sprinkler conduits 1240 with respect to the ceiling 1230 surface, due to the practicalities of building construction. To ensure the correct position of the deployed deflector 145, the distance between the face 1250 of the conduit output fitting 1235 and the ceiling 1230 should not be more than 2 inches.

The field adjustment is achieved by allowing the escutcheon 1210 to be positioned with a varying degree of overlap with the outer walls 175 of the support cup 170. The support cup 170 and escutcheon 1210 are configured so that any secure engagement between these components results in a proper position for the deployed deflector 145.

The amount of field adjustment, which in this example is 0.5 inch, is determined by the length of the rods 165 of the deflector support members 150, because the length of the rods 165 determines the amount of variation that can be accommodated in the position of the conduit 1240 relative to the ceiling line 1230. In other words, the rods 165 may be completely retracted within the housing member 155 before deployment, such as when the conduit 1240 and, therefore the sprinkler 100, is positioned as close as possible to the ceiling line 1230. Alternatively, the rods 165 may be nearly ¾ extended before deployment, such as when the conduit 1240 is positioned as far as possible above the ceiling line 1230. The length of the rods 165, in turn, determines the height of the outer walls 175 of the support cup 170. Thus, the outer walls 175 of the support cup 170 must have a height of slightly more than 0.5 inch in the example described herein.

Configuring the deflector support members 150 such that the rods 165 extend through the housing members 155 and the flange 140 allows for the use of a shallower cup, because the depth of the support cup is primarily determined by the length of the rods 165. This in turn results in the thermally-responsive element being located closer to the ceiling line, thereby improving sprinkler sensitivity. By contrast, in conventional concealed sprinklers, the guide pins coupled to the deflector are generally positioned below the flange, thereby requiring a deeper support cup (because the depth of the support cup is determined by the length of the guide pins plus the flange thickness). Consequently, the thermally-responsive element is located farther from the ceiling line, resulting in reduced sprinkler sensitivity.

Figure 14:
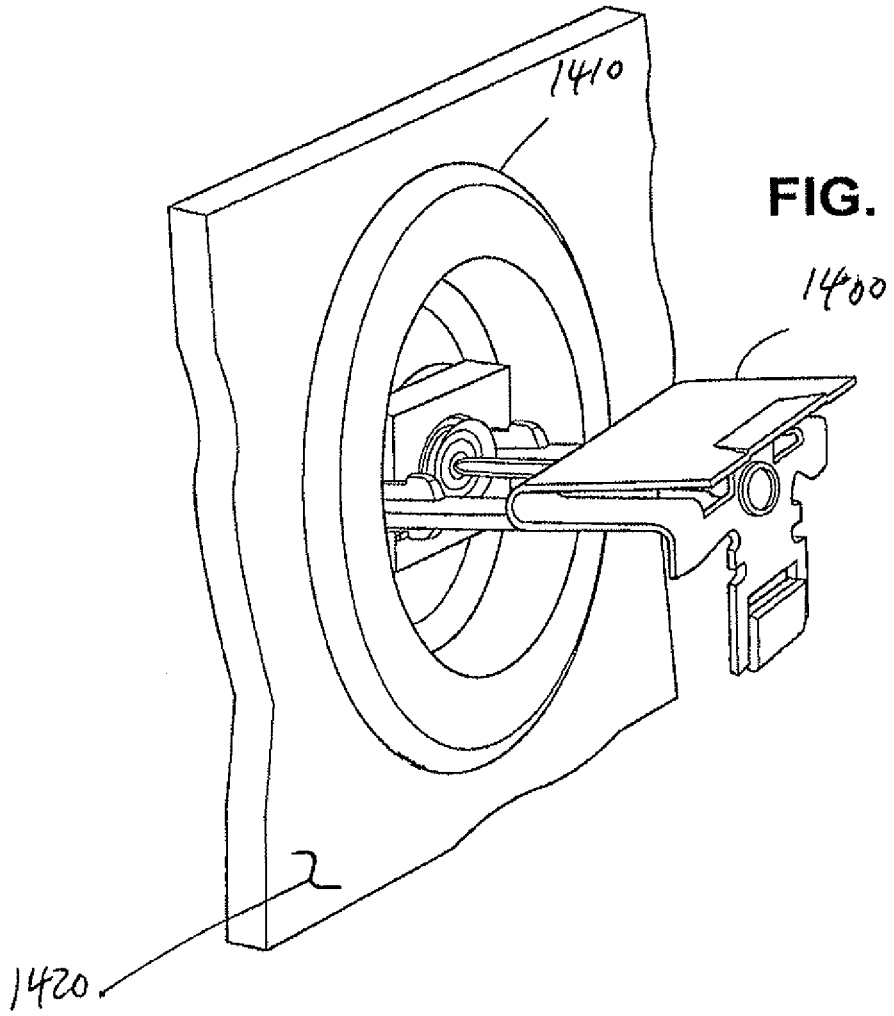
FIG. 14 is a perspective view of an embodiment of a horizontal sidewall sprinkler installed in a support cup assembly of a non-concealed configuration.

As shown in FIG. 14, a horizontal sidewall sprinkler 1400 in accordance with the present invention may be installed in a non-concealed configuration in a support cup assembly 1410. The support cup 1410 assembly is mounted in a wall 1420, a predetermined distance below a ceiling. The sprinkler 1400 is connected to a conduit (not shown) behind the wall 1420 that provides pressurized fire-extinguishing fluid, such as water.

Figure 15:
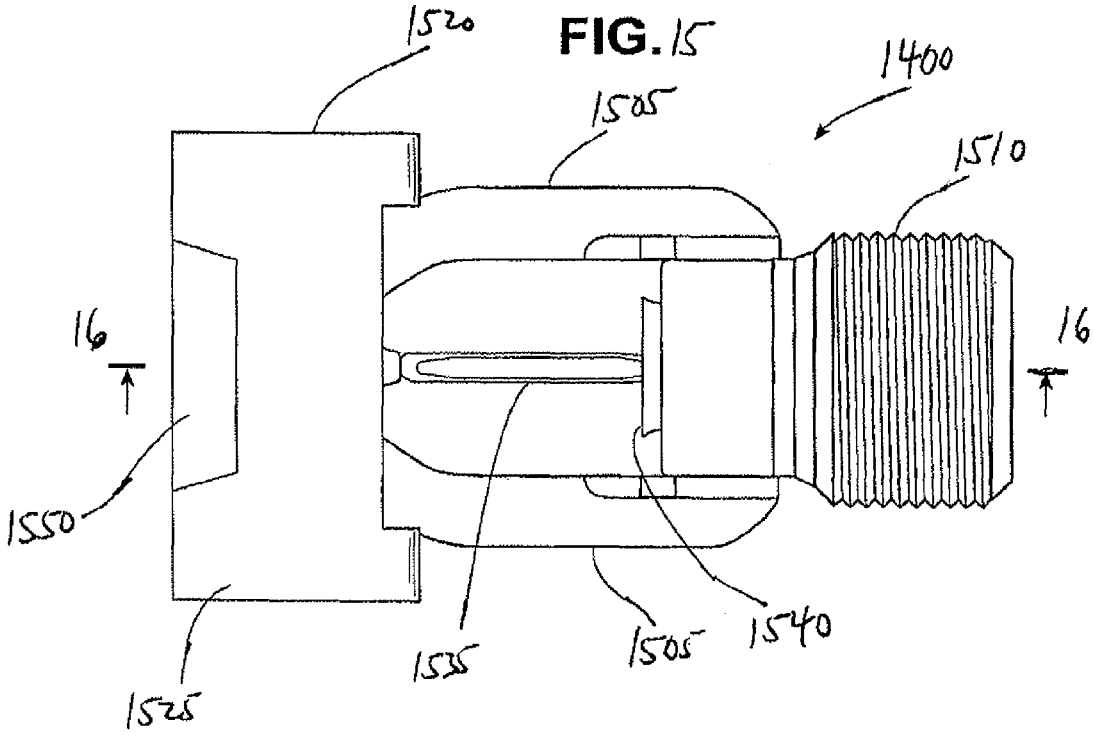
FIG. 15 is a top view of the horizontal sidewall sprinkler.
Figure 16A:
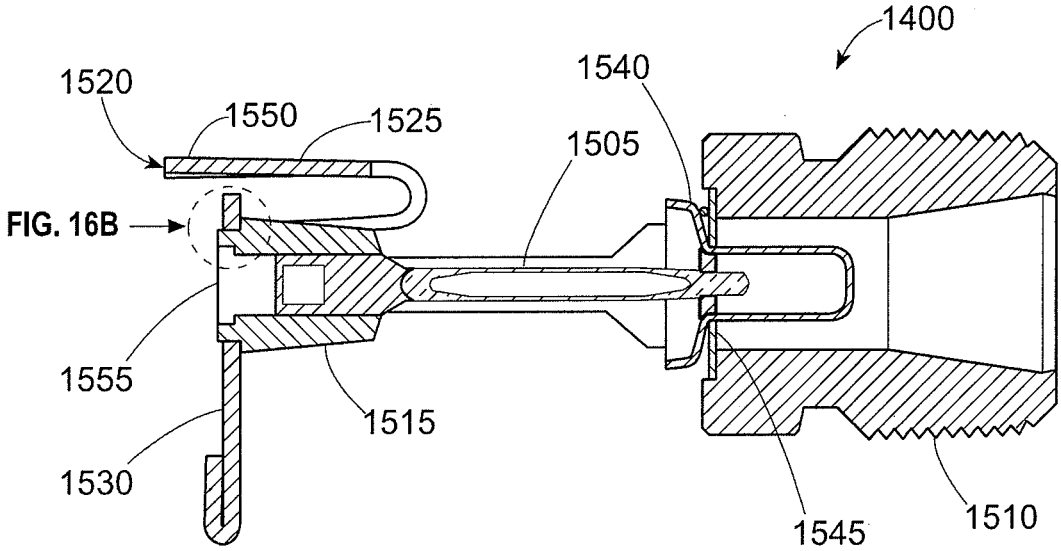
FIG. 16A is a side sectional view of the horizontal sidewall sprinkler.

As shown in the top view of FIG. 15 and side section view of FIG. 16A, the sprinkler 1400 has two frame arms 1505 that extend from a threaded base portion 1510 and meet at a hub 1515 (see FIG. 16A), on which a deflector 1520 is mounted. The deflector 1520 has a horizontal shelf 1525 and a vertical face 1530, approximately perpendicular to the shelf 1525. The fire-extinguishing fluid flows both over the top of and under the shelf 1525.

The sprinkler 1400 also has a thermally-responsive element, such as for example a frangible bulb 1535, positioned between the hub 1515 and a seal cap 1540 to hold the seal cap in place over the output orifice 1545. The bulb 1535 is designed to break at a predetermined temperature, thereby releasing the seal cap 1540 (due to the pressure of the fluid in the conduit) and allowing the fluid to be output from the orifice 1545. The output orifice may have a diameter of, for example, ½ inch NPT (national pipe thread). The sprinkler may have a K-factor of, for example, 4.4, which is defined by $K=Q/\sqrt{p}$, where Q is the flow rate in gallons per minute and p is the residual pressure at the inlet of the sprinkler in pounds per square inch. Of course, other types of thermally-responsive elements may be used, including but not limited to, for example, a fusible link assembly, or a sensor, strut, and lever assembly.

The deflector shelf 1525 has an upwardly-angled, inclined portion 1550 on the front edge, i.e., the edge facing away from the output orifice 1545. The inclined portion 1550 provides an upward vertical deflection to the fluid flow, which in turn imparts an upward trajectory to a portion of the fluid flow. This upward trajectory results in the fluid reaching a higher point on the opposite wall, which helps the sprinkler meet opposite wall wetting height requirements. The incline 1550 is substantially planar and extends across a large portion of the width of the shelf 1525. This configuration helps provide a uniform upward deflection to a significant portion of the output stream without imparting substantial additional horizontal deflection.

Figure 16B:
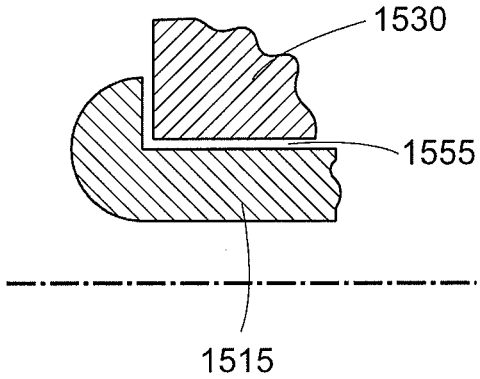
FIG. 16B is an exploded view of a portion of the horizontal sidewall sprinkler identified in FIG. 16 showing an alternate configuration of the attachment of the hub to the deflector.

As shown in FIG. 16A, the deflector 1520 is attached to the end of the hub 1515 via a fastener that passes though an opening 1555 in the vertical face 1530 of the deflector 1520. Also, in an alternate configuration shown in FIG. 16B, the hub 1515 itself includes a portion that extends through the opening 1555 and is flared over the opening 1555 to attach the deflector to the hub. In the embodiment shown, the deflector shelf 1525 is horizontal, and is parallel with the frame arms 1505, but the shelf 1525 also may be angled slightly upward to help achieve a desired spray pattern.

Figure 17:
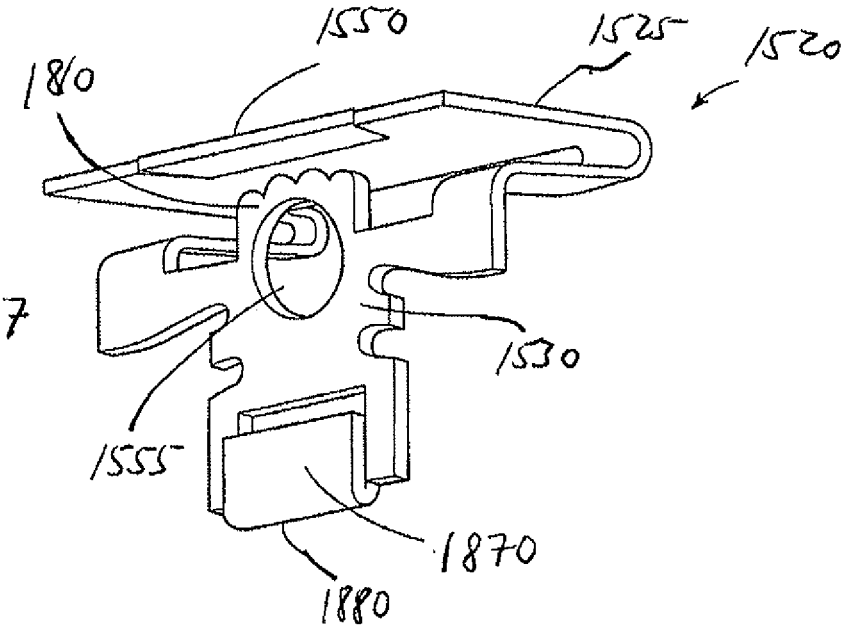
FIG. 17 is an isometric view of the horizontal sidewall sprinkler deflector.
Figure 19:
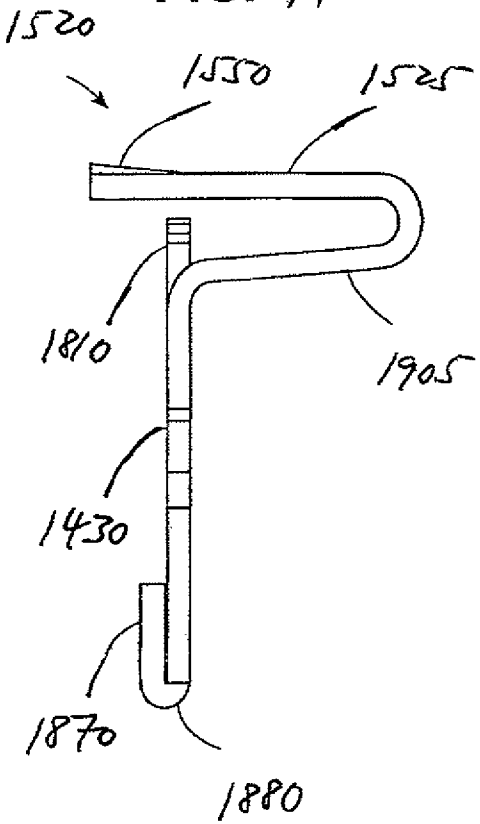
FIG. 19 is a side plan view of the deflector.
Figure 18:
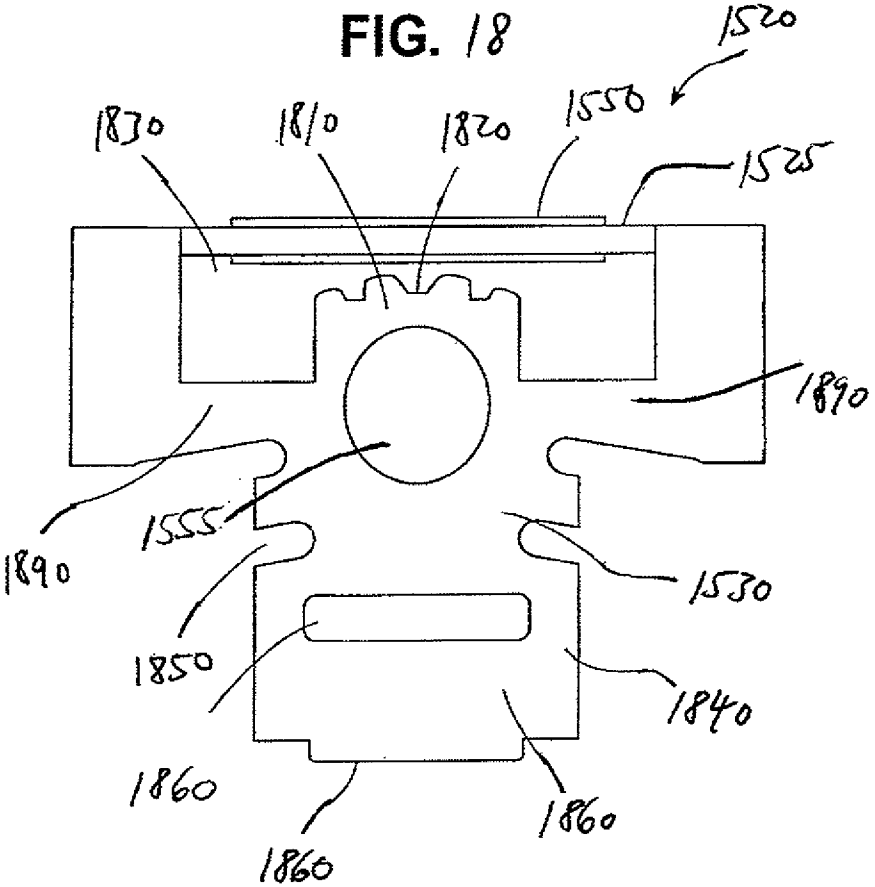
FIG. 18 is a rear plan view of the deflector.

The deflector 1520, as shown in FIGS. 17-19, may be formed by stamping a thin piece of metal to form a flat blank (not shown) having a desired outer shape, with internal cutouts. For example, the blank may be formed of brass, or brass alloy, and may for example be about 0.05 inch thick. While this dimension is present in this embodiment, it is within the reach of ordinary skill to make a sprinkler that would operate satisfactorily with a value that departs somewhat from this, and to make a sprinkler that would be operable without using these exemplary values. The blank is folded to achieve the final shape of the deflector 1520, including the horizontal shelf 1525. As noted above, the vertical face 1530 of the deflector 1520 has an opening 1555 in a central portion thereof to receive the fastener that attaches it to the hub 1515 (see FIG. 16). Above the fastener opening 1555 is an upper portion 1810 of the vertical face 1530 with notches 1820 (see FIG. 18) formed on the edge thereof. A portion of the output fluid flows through the opening 1830 formed between the upper portion 1810 of the vertical face 1530 and the bottom of the shelf 1525 and is dispersed by the notches 1820 to help achieve a desired spray pattern.

The vertical face 1530 also has a lower portion 1840 extending below the fastener opening 1555. The lower portion 1840 is generally rectangular with notches 1850 formed on the sides and a rectangular window 1860 formed near the bottom of the lower portion 1840 that allows a portion of the output fluid to pass through. The bottom edge of the lower portion 1840 has a folded portion 1870 below the window 1860 that provides a thicker, more rounded bottom edge 1880 to the lower portion 1840. The folded portion 1870 is formed, for example, by folding a tab provided in the flat blank. This configuration helps reduce the dispersive edge effects of the bottom edge 1880, which may cause fluid to spray back toward the sprinkler. Thus, the window 1860 and folded portion 1870 help to project more fluid in front of the plane of the vertical face 1530 and also help to create a more uniform spray pattern on the floor. This in turn helps the sprinkler meet floor collection (i.e., density) requirements.

Two arm portions 1890 of the deflector, which extend from the sides of the fastener opening 1555, are formed in the fabrication process discussed above by cutting out an opening 1830 in the flat blank between the shelf 1525 and the vertical face 1530. The arm portions 1890 extend in the plane of the vertical face 1530 and then, as shown in the side view of FIG. 19, bend approximately 85° to form two backwardly extending (i.e., toward the base of the sprinkler) arm portions 1905 in a horizontal plane approximately parallel to the shelf 1525. These backwardly extending arm portions 1905 then bend to form part of the back edge of the deflector shelf 1525. The shelf 1525 forms an angle of about 90° with respect to the vertical face 1530 and about 185° with respect to the backwardly extending arm portions 1905. In addition, the tab of the folded portion 1870 at the bottom of the vertical face forms an angle of about 2° with respect to the vertical face 1530.

FIG. 19 also shows that the majority of the length of the deflector shelf 1525 (as measured in the generally horizontal direction of fluid output) is rearwardly positioned with respect to the vertical face 1530 of the deflector 1520. In other words, the portion of the shelf 1525 extending in front of the vertical face 1530 of the deflector is less than about 50% of the total length of the shelf. For example, the shelf 1525 may have a length of about 0.65 inch, but may extend forward beyond the vertical face 1530 of the deflector by only about 0.23 inch. In such a case, the forwardly-extended portion of the shelf would be only about 35% of the total length of the shelf. Other proportions also are possible. For example, the forwardly-extended portion of the shelf may be about one third or less of the total length. Thus, the shelf 1525 is "shorter" than a conventional horizontal sidewall design, in the sense that it does not extend as far forward beyond the vertical face 1530 of the deflector 1520. While these dimensions are present in this embodiment, it is within the reach of ordinary skill to make a sprinkler that would operate satisfactorily with values that depart somewhat from these, and to make a sprinkler that would be operable without using these exemplary values.

The shorter shelf 1525 results in less bending stress and greater stability for the deflector 1520, while maintaining the required spray pattern. As shown in FIG. 14, the shorter shelf 1525 also results a shorter overall length for the sprinkler 1400, which helps reduce the risk of damage to installed units and improves the aesthetic characteristics of the sprinkler. In addition, as discussed below, the shorter shelf allows for the use of a lower-profile cover in the concealed configuration (i.e., a cover that is narrower and/or does not extend as far from the wall surface).

Figure 20:
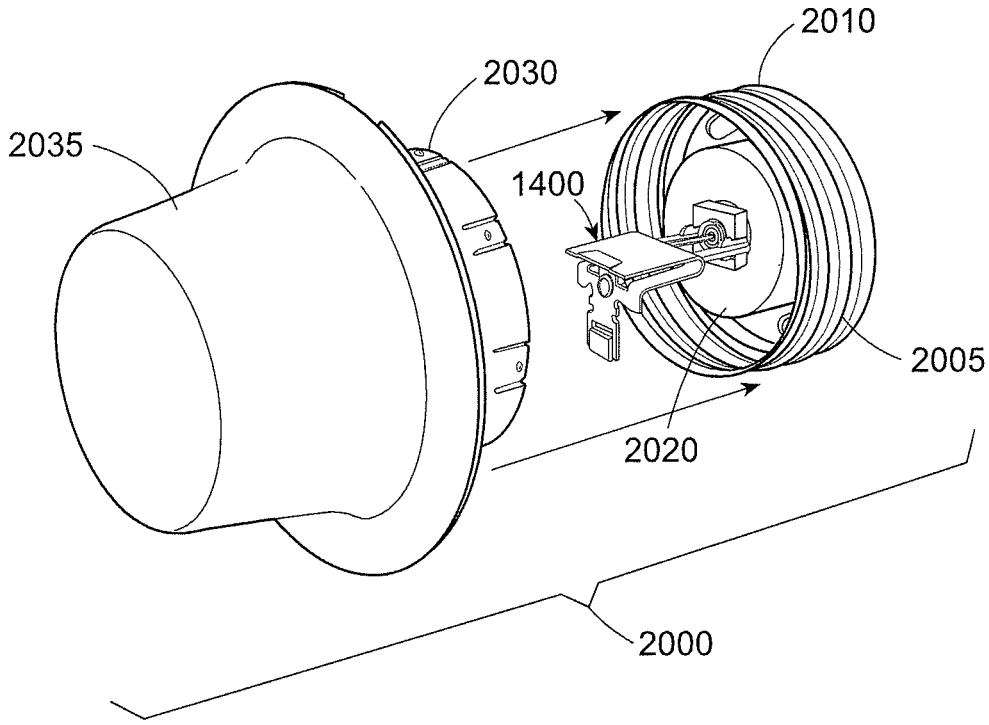
FIG. 20 is a perspective exploded view of the horizontal sidewall sprinkler installed in a support cup/escutcheon/cover assembly of a concealed configuration.

In an alternative embodiment, as shown in FIG. 20, the sprinkler 1400 depicted in FIGS. 15-19 may be mounted in a concealed configuration in a support cup/cover assembly 2000. The support cup 2010 is generally circular, with a cylindrical, ridged outer surface 2015 around its circumference and a raised mounting platform 2020 positioned in its central portion. The cup 2000 is configured to be mounted in a cavity in a wall, a predetermined distance below the ceiling. The sprinkler 1400 is mounted in, and extends horizontally, from the platform 2020 in the center of the support cup 2010. An escutcheon 2030 and cover 2035 assembly, discussed in further detail below, is placed over the sprinkler 1400 to protect it from damage and provide an aesthetically pleasing appearance.

Figure 22:
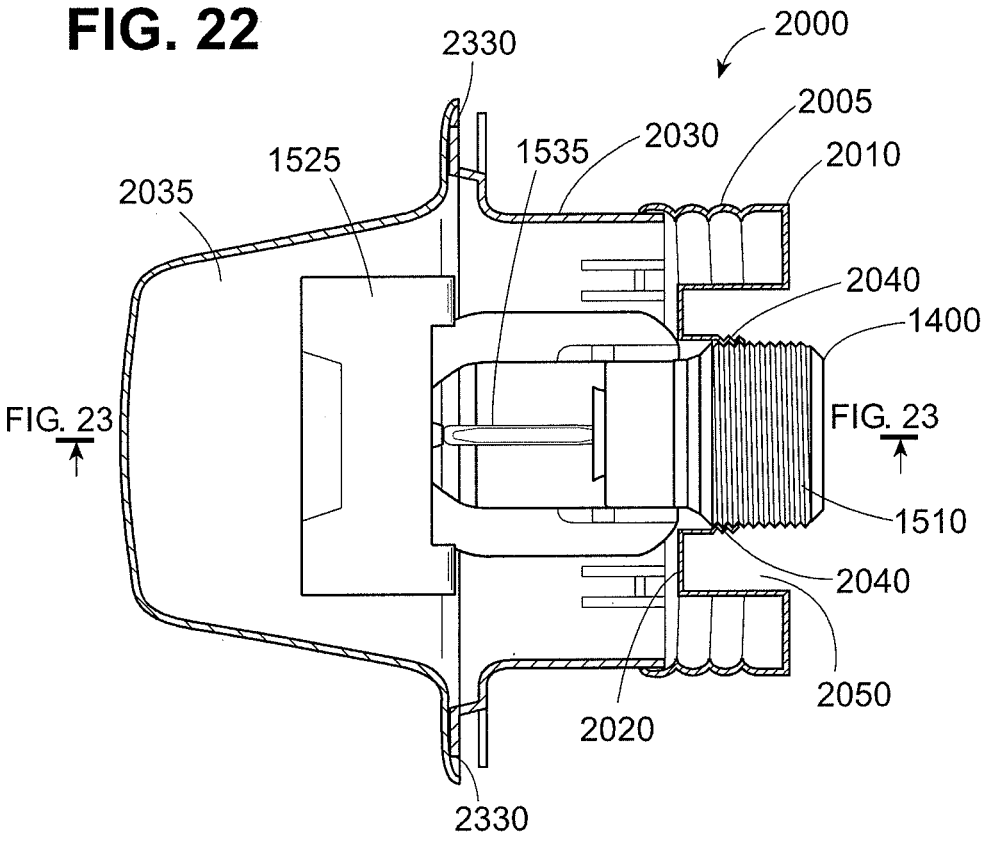
FIG. 22 is a top sectional view of the support cup/escutcheon/cover assembly of the concealed configuration, showing the sprinkler mounted therein.
Figure 23:
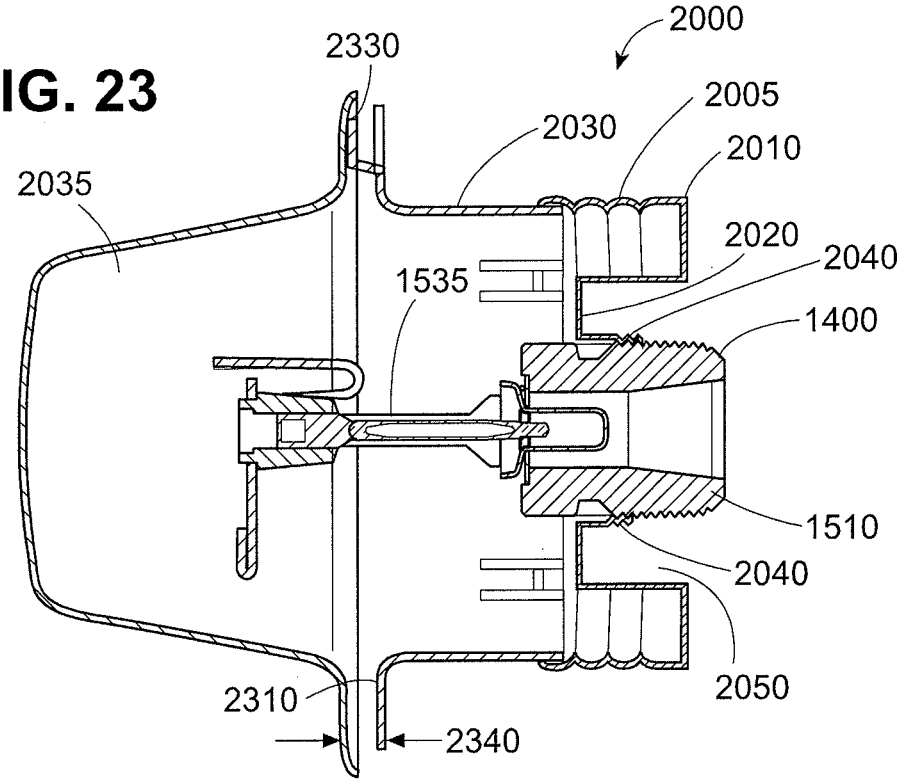
FIG. 23 is a side sectional view of the support cup/escutcheon/cover assembly of the concealed configuration, showing a side sectional view of the sprinkler.

FIG. 22 shows a top sectional view (looking down on the upper surface of the deflector shelf 1525) of the support cup/escutcheon/cover assembly 2000 with the sprinkler 1400 installed. FIG. 23 shows a side sectional view of this assembly, with the sprinkler 1400 shown in section. The cup 2010, as noted above, has a ridged outer surface 2005 around its circumference and a raised mounting platform 2020 in the center. The sprinkler 1400 is mounted in the platform 2020 by screwing the threaded base portion 1510 into an opening in the center of the platform 2020. The opening has an inwardly-extended, threaded rim 2040 (as shown) or alternatively, tabs, that act as thread guides to interlock with the threaded base portion 1510 to hold the sprinkler 1400 in place. The mounting platform 2020 has a significantly larger radius that the base portion 1510 of the sprinkler 1400, so as to leave an annular volume 2050 around the base 1510, to allow sufficient room for connection of the sprinkler to the output head (e.g., fitting 123, FIG. 13) of the conduit (e.g., conduit 1240, FIG. 13).

Figure 21:
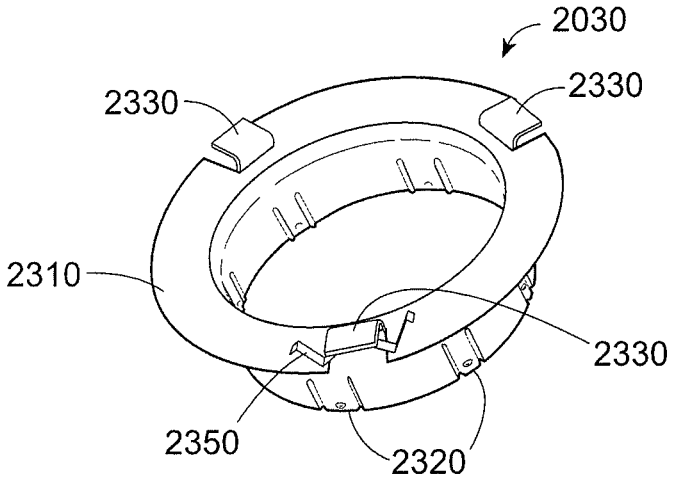
FIG. 21 is a perspective view of the escutcheon.

A portion of the sprinkler 1400 is surrounded by a cylindrical escutcheon 2030. As shown in FIG. 21, the escutcheon 2030 has a circumferential flange 2310 on its outwardly facing end. The escutcheon 2030 installs with a press fit into the ridged outer surface 2005 of the support cup 2010 (see FIGS. 23 and 23), so that the flange 2310 rests on the outer surface of the wall in which the cup 2010 is installed. The escutcheon 2030 may be formed, for example, of metal, e.g., steel or brass, having a thickness of about 0.020 inch. The escutcheon 2030 in FIG. 21 has tabs 2320 located on the cup-installation edge of the cylindrical portion, in order to act as stops to ensure the escutcheon 2030 is not inserted into the cup 2010 beyond a desired depth.

The escutcheon flange 2310 includes raised portions 2330 around its periphery that act as mounting points for the cover 2035. The cover 2035 is connected to these raised portions 2330, resulting in a gap 2340 (see FIGS. 22 and 23) being formed between the cover 2035 and the escutcheon 2030, which allows air flow to reach the sprinkler 1400. The cover 2035 is attached to these mounting points 2330 with solder that is designed to melt at a predetermined temperature to allow for release of the cover 2035. Small springs 2350 formed of thin, bent metal tabs (only one of which is depicted), or similar spring structures, may be installed at the mounting points 2330 to urge the cover 2035 away from the flange 2310, to help insure proper ejection of the cover 2035.

Figure 24:
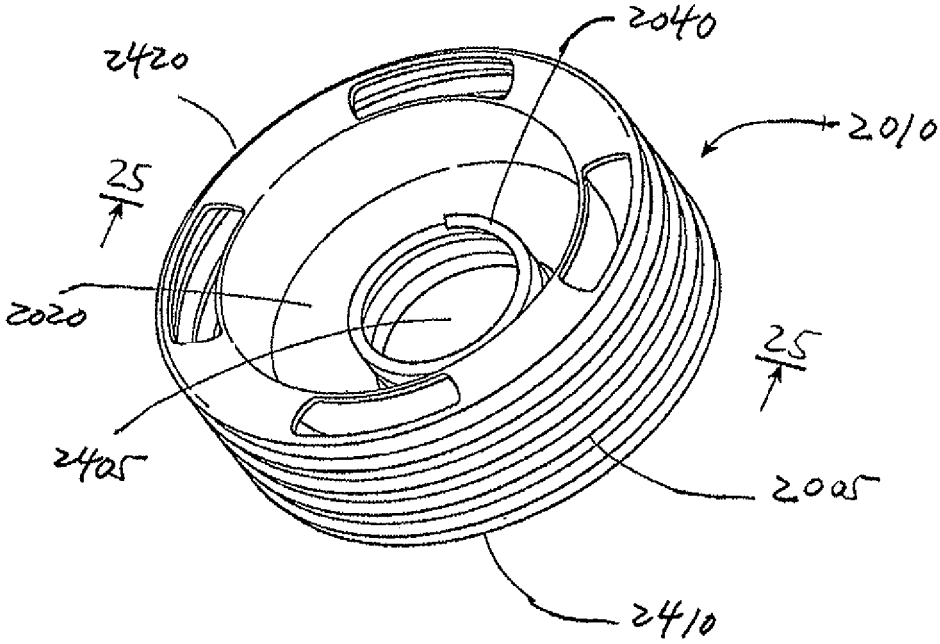
FIG. 24 is a rear isometric view of the support cup of the concealed configuration.
Figure 25:
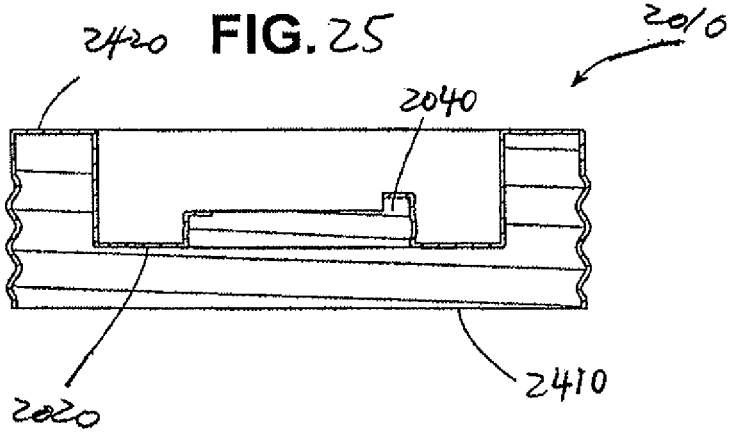
FIG. 25 is a side sectional view of the support cup of the concealed configuration.

FIG. 24 is a rear isometric view of the support cup 2010 for the concealed configuration, i.e., a view from the side opposite that from which the sprinkler extends. FIG. 25 is a side sectional view oriented so that the installed sprinkler would extend downward with respect to the drawing sheet. As noted above, the sprinkler 1400 is installed in a mounting platform 2020 in the central portion of the support cup 2010 (see FIGS. 22 and 23). The threaded base portion 1510 of the sprinkler 1400 fits within an opening 2405 in the mounting platform 2020 and interlocks with a threaded rim 2040 within the opening 2405. The mounting platform 2020 is forwardly-extended, such that the surface of the mounting platform 2020 is closer to the forward facing edge 2410 of the support cup 2010 than the rear edge 2420 in the axial direction. For example, the distance from the surface of the mounting platform 2020 to the forward edge 2410 of the support cup 2010 may be about 0.25 inch, while the distance to the rear edge 2410 may be about 0.5 inch. While these dimensions are present in this embodiment, it is within the reach of ordinary skill to make a sprinkler that would operate satisfactorily with values that depart somewhat from these, and to make a sprinkler that would be operable without using these exemplary values.

The forwardly-extended mounting platform 2020 arrangement results in the sprinkler 1400 being positioned so that the thermally-responsive element 1535 extends beyond the wall plane, i.e., beyond the rim 2310 of the escutcheon 2030. In other words, the thermally-responsive element 1535 extends into the gap 2340 between the escutcheon 2030 and the cover 2035 (see FIGS. 22 and 23), in the generally horizontal direction, and may extend at least partially into the cover 2035. Such an arrangement is advantageous in that the thermally-responsive element 1535 is more exposed to the air flow entering the assembly through the gap 2340 between the cover 2035 and the escutcheon 2030, resulting in Unproved responsiveness of the sprinkler. This advantage is particularly important for applications requiring faster response time, such as residential applications.

The support cup/cover assembly described above also may be used in conjunction with pendent sprinklers. For example, a pendent sprinkler may be mounted in the support cup installed in a ceiling. The escutcheon/cover assembly is inserted into the support cup so that the flange of the escutcheon is flush with the ceiling. The pendent sprinkler may have arms that meet at a hub, to which a deflector is attached. Alternatively, the pendent sprinkler may be a "frameless" sprinkler, which does not have arms and a hub, but instead has a thermally-responsive element releasably mounted on the sprinkler body to hold the seal cap in place and a drop-down deflector.

In addition, the support cup described above may be used with other types of escutcheons and covers, or without a cover, in either a horizontal or pendent configuration. For example, a pendent sprinkler may be mounted in the support cup, as described above, mounted in a ceiling. In such a case, the sprinkler would be positioned so that its thermally-responsive element would be more exposed to air flow, due to the forwardly-extended mounting platform in the support cup.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

Figure 31:
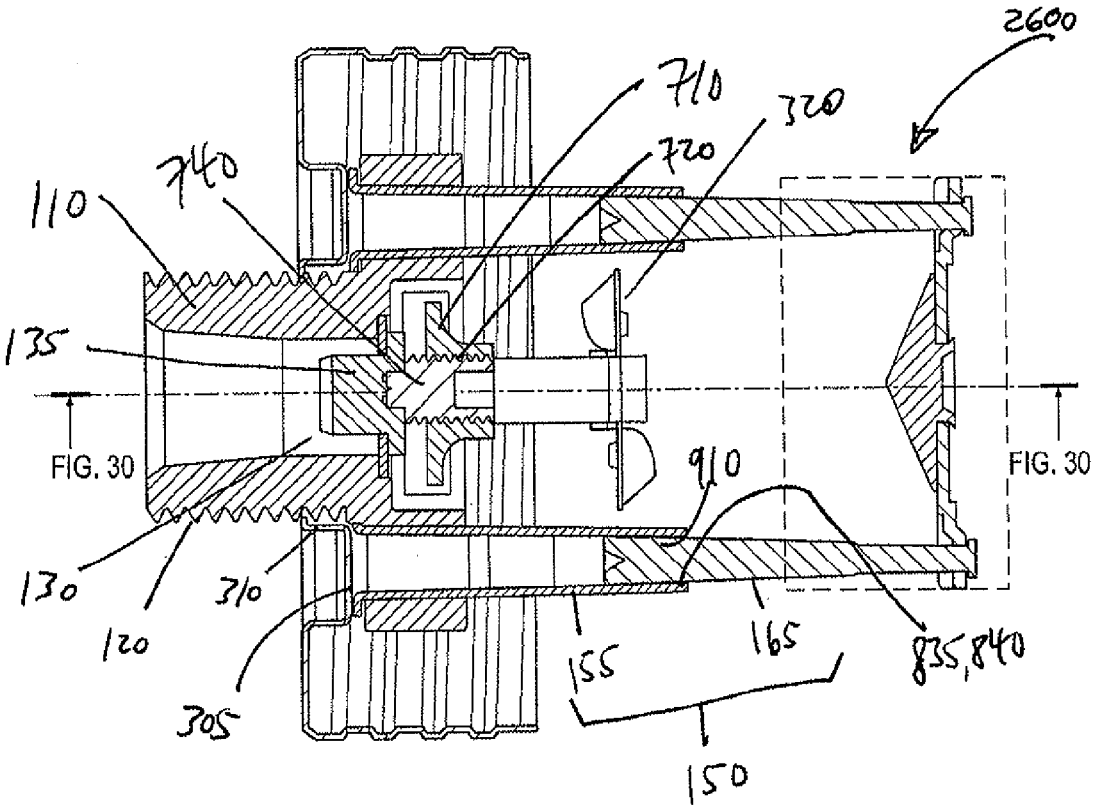
FIG. 31 is a sectional top view of the horizontal sidewall sprinkler of FIG. 26 in another operating condition.

As shown in FIGS. 26 and 31, a sidewall concealed fire protection sprinkler 2600 in accordance with the present disclosure has a structure that combines some features of the sprinkler shown in FIG. 1 with some of the features of the deflector 1520 shown in FIG. 14. For example, deflector 2620 has a structure similar in many relevant respects to the sidewall horizontal deflector 1520 shown in FIG. 14. Accordingly, for clarification, like elements among the various figures are shown with like reference numerals.

The sprinkler includes a sprinkler body 110 having an output orifice which may have a diameter of, for example, ½ inch NPT (national pipe thread). The sprinkler may have a K-factor of, for example, 4.4.

The deflector 2620 shown in FIGS. 26-32 and 34 has a horizontal shelf 2625 and a vertical face 2630, approximately perpendicular to the shelf 2625. The fire-extinguishing fluid flows both over the top of and under the shelf 2625.

The deflector shelf 2625 has an upwardly-angled, inclined portion 2650 on the front edge, i.e., the edge facing away from the outlet orifice 130. The inclined portion 2650 provides an upward vertical deflection to the fluid flow, which in turn imparts an upward trajectory to a portion of the fluid flow. This upward trajectory results in the fluid reaching a higher point on the opposite wall, which helps the sprinkler meet opposite wall wetting height requirements. The incline 2650 is substantially planar and extends across a large portion of the width of the shelf 2625. This configuration helps provide a uniform upward deflection to a significant portion of the output stream without imparting substantial additional horizontal deflection.

The deflector 2620 is coupled to two deflector support members 150 on opposite sides of the sprinkler body 110. Each of the deflector support members 150 includes a housing 155 and a rod 165. The rods 165 of the two deflector support members 150 are connected to the vertical face 2630 of the deflector 2620 at two openings 2656 formed on opposite sides of a central opening 2655 (FIG. 27) formed in the vertical face 2630. In the embodiment shown in FIG. 26, the deflector shelf 2625 is horizontal, and is parallel with two deflector support members 150, but the shelf 2625 also may be angled slightly upward to help achieve a desired spray pattern.

The deflector 2620, as shown in FIGS. 26-32 and 34, may be formed in the same fashion as the deflector 1520 shown in FIG. 17. On both sides of the central opening 2655 are formed two mounting holes 2656, discussed below. Above the central opening 2655 is an upper portion 2710 of the vertical face 2630 with notches 2720 (see FIG. 18) formed on the edge thereof. A portion of the output fluid flows through the opening 2730 (FIG. 29) formed between the upper portion 2710 of the vertical face 2630 and the bottom of the shelf 2625 and is dispersed by the notches 2720 to help achieve a desired spray pattern.

On a side of the vertical 2630 face opposite the output direction, a conical portion 1020 extends rearwardly. On one side of the vertical face 2630 in the output direction a round flange extends around the rim of central opening 2655. The flange can be formed as a result of crimping or swedging the conical portion 1020 onto the central opening 2655.

As discussed above with respect to FIG. 11, the conical member 1020, which has an outer diameter of 0.7 inch and an included angle of 130°, faces the output orifice 130 to assist in the dispersion of the output fluid and to improve the stability of the deployed deflector 2620. A conical indentation 1030 having an included angle of about 118° to about 120° is formed in the base of the conical member 1020 (which has a diameter of 0.245 inch) to allow it to achieve a secure press fit in the central opening 2655 of the deflector 2620. While these dimensions are present in this embodiment, it is within the reach of ordinary skill to make a sprinkler that would operate satisfactorily with values that depart somewhat from these, and to make a sprinkler that would be operable without using these exemplary values. The conical member 1020 also helps prevent the seal cap 135 and other ejected components from becoming lodged behind the deflector 2630 upon activation of the sprinkler 2600 upon separation of the fusible soldered link 320, mentioned above in connection with FIGS. 3 and 4, and discussed hereinbelow.

The vertical face 2630 also has a lower portion 2740 extending below the central opening 2655. The lower portion 2740 is generally rectangular with notches 2750 formed on the sides and a rectangular window 2760 formed near the bottom of the lower portion 2740 that allows a portion of the output fluid to pass through. A bottom edge 2780 of the lower portion 2740 has a folded portion 2770 below the window 2760 that provides a thicker, more rounded bottom edge 2780 to the lower portion 2740. The folded portion 2770 is formed, for example, by folding a tab provided in the flat blank. This configuration helps reduce the dispersive edge effects of the bottom edge 2780, which may cause fluid to spray back toward the sprinkler. Thus, the window 2760 and folded portion 2770 help to project more fluid in front of the plane of the vertical face 2630 and also help to create a more uniform spray pattern on the floor. This in turn helps the sprinkler meet floor collection (i.e., density) requirements.

Two arm portions 2790 (FIG. 29) of the deflector 2620, which extend from the sides of the central opening 2655, are formed in the fabrication process discussed above by cutting out an opening 2730 in the flat blank between the shelf 2625 and the vertical face 2630. The arm portions 2790 extend in the plane of the vertical face 2630 and then, as shown in the side elevation view of FIG. 28, bend approximately 85° to form two backwardly extending (i.e., toward the base of the sprinkler) arm portions 2805 in a horizontal plane approximately parallel to the shelf 2625 and parallel to the deflector support members 150. The mounting holes 2656 are formed in the arm portions 2790, which are used for coupling the rods 165 to the deflector 2620 such as by crimping. The backwardly extending arm portions 2805 then bend upward and forward towards the rear edge of the deflector shelf 2625. The rear edge of the shelf 2625 and the portions of the arms 2805 extending from the rear edge of the shelf define a notch 2806. The notch 2806 extends rearwardly to accommodate an upper edge of the link 315 extending vertically in the notch 2806. The shelf 2625 forms an angle of about 90° with respect to the vertical face 2630 and about 185° with respect to the backwardly extending arm portions 2805. In addition, the tab of the folded portion 2770 at the bottom of the vertical face 2630 forms an angle of about 2° with respect to the vertical face 2630. While these dimensions are present in this embodiment, it is within the reach of ordinary skill to make a sprinkler that would operate satisfactorily with values that depart somewhat from these, and to make a sprinkler that would be operable without using these exemplary values.

Figure 29:
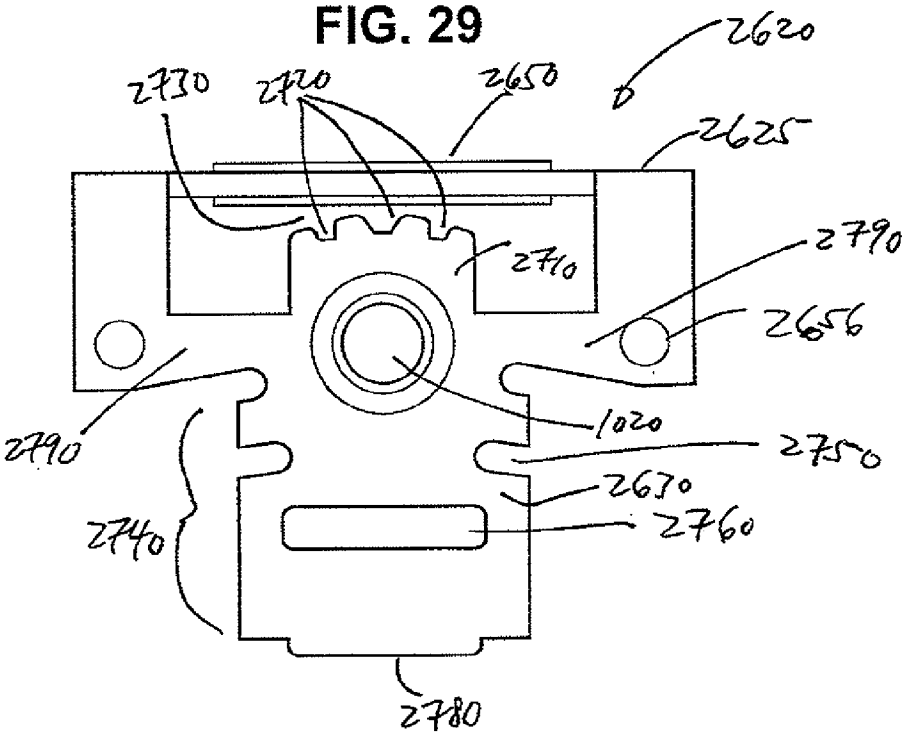
FIG. 29 is a rear plan view of the deflector of FIG. 26.
Figure 28:
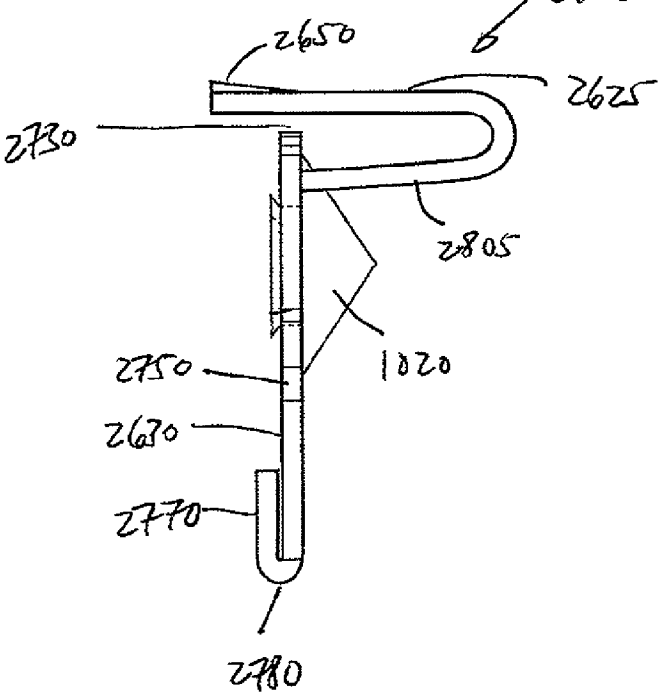
FIG. 28 is a side plan view of the deflector of FIG. 26.

FIG. 29 also shows that the majority of the length of the deflector shelf 2625 (as measured in the generally horizontal direction of fluid output) is rearwardly positioned with respect to the vertical face 2630 of the deflector 2620. In other words, the portion of the shelf 2625 extending in front of the vertical face 2630 of the deflector is less than about 50% of the total length of the shelf. For example, the shelf 2625 may have a length of about 0.65 inch, but may extend forward beyond the vertical face 2630 of the deflector by only about 0.23 inch. In such a case, the forwardly-extended portion of the shelf would be only about 35% of the total length of the shelf. Other proportions also are possible. For example, the forwardly-extended portion of the shelf may be about one third or less of the total length. Thus, the shelf 2625 is "shorter" than a conventional horizontal sidewall design, in the sense that it does not extend as far forward beyond the vertical face 2630 of the deflector 2620. While these dimensions are present in this embodiment, it is within the reach of ordinary skill to make a sprinkler that would operate satisfactorily with values that depart somewhat from these, and to make a sprinkler that would be operable without using these exemplary values.

The shorter shelf 2625 results in less bending stress and greater stability for the deflector 2620, while maintaining the desired spray pattern. The shorter shelf 2625 also results a shorter overall length for the sprinkler 2600, which helps reduce the risk of damage to installed units and improves the aesthetic characteristics of the sprinkler. In addition, as discussed below, the shorter shelf 2625 allows for the use of a flat cover 3201 (FIGS. 32-34) in the concealed configuration. One result of using the flat cover 3201 is that the cover extends less from the surface of the wall 3401 (FIG. 34) than truncated conical cover 2035 shown in FIGS. 20-23, which is viewed by some as improving the aesthetics of the cover.

Figure 30:
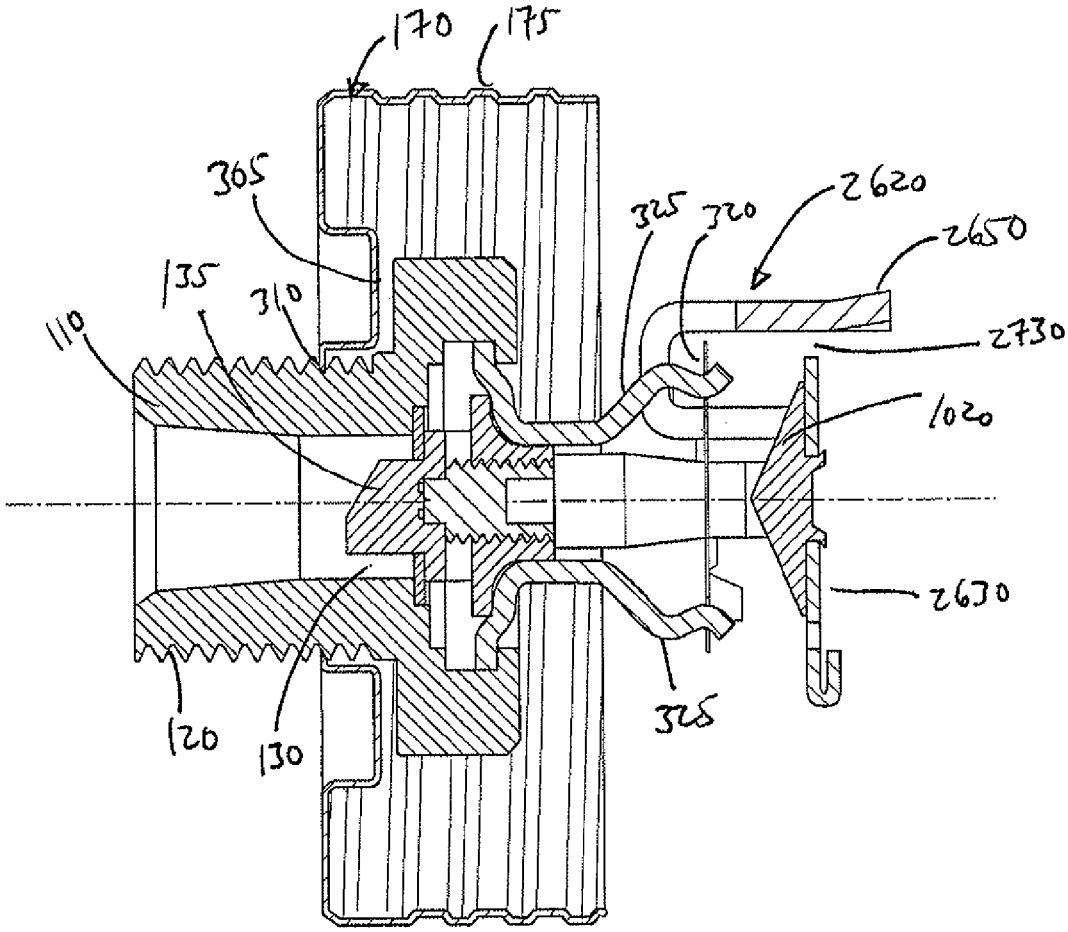
FIG. 30 is a sectional view of a horizontal sidewall sprinkler of FIG. 26 in an assembled condition.

As shown by comparing FIGS. 30 and 31, during operation, rods 165 slide from an initial position in which a large portion of the length of the rod 165 is within the housing member 155 to a deployed position (e.g., FIG. 31), in which a substantial portion of the length of the rod 165 extends from a forward end of the housing member 155. Accordingly, in the deployed position, the deflector 2620 moves in the output direction along with the rods 165.

The sprinkler 2600 is mounted in a support cup 170 having a cylindrical, threaded outer wall 175, which surrounds a portion of the installed sprinkler 2600 and, as discussed below, allows for installation into a wall cavity. The support cup 170 also has a mounting platform 305 with a hole in the center into which the sprinkler body 110 is inserted. The hole has a threaded rim portion 310 or tabs configured to interlock with the threads of the sprinkler base 120.

As shown in FIG. 31, the sprinkler also has a fusible soldered link 320, formed as a fusible link that holds the seal cap 135 in place over the output orifice 130, e.g., a fusible soldered link 320 attached to the ends of two levers 325, as shown in FIG. 4 and described above. The link 320 separates at the predetermined temperature, due to the force applied by the levers 325, allowing the levers 325 to swing outward (FIG. 31), to in turn, release the seal cap 135 and allow the fluid to be output from the orifice 130. Of course, other types of thermally-responsive elements may be used, including, but not limited to, for example, a frangible bulb and lever assembly, or a sensor, strut, and lever assembly.

Referring again to FIG. 31, the levers 325 swing outward upon release of the fusible link 320 due to the force of the fluid in the conduit against the seal cap 135 and a pre-tension force supplied by a loading yoke 710, shown in FIG. 7, and described above. A load screw 740 extends completely through the bore 720 of the yoke 710 and rests in an indentation in the seal cap 135. The yoke 710 is forced against the levers 325 by the tightening of the load screw 740 against the seal cap 135, thereby forcing the levers 325 away from one another.

The construction of the housing members 155 and the rods 165 shown in FIGS. 30 and 31 correspond to those described above with respect to FIGS. 8-10. Of course, modifications to the dimensions of the preferred dimensions disclosed with the respect to the structures shown in FIGS. 1-34 are within the spirit and scope of this disclosure. With respect to the frustoconical portion 910 of rod 165 shown in FIG. 9, in the sidewall concealed sprinkler 2600, the frustoconical portion 910 helps hold the rod 165 in rigid position at the forward end of the housing member 155 in the deployed position. When the deflector 2620 is deployed (see, e.g., FIGS. 26 and 31), the first frustoconical portion 910 of the rod 165 lodges in the second frustoconical portion 835 and third cylindrical portion 840 of the housing member 155. By using the above described configuration, the deflector 2620 is more stable when deployed, allowing for a consistent sprinkler spray pattern. By contrast, without such a configuration, the force of the fluid output may cause the deflector 2620 to wobble or shift to, and possibly jam in, an askew position, resulting in an undesirable spray pattern.

The stability of the configuration of the embodiment described above with respect to FIGS. 26 to 31 is, in part, attributed to the resiliency in the first frustoconical portion 910 of the rod 165, which provides a substantially locking fit between the rod 165 and the housing member 155. This in turn provides stability to the deployed deflector 2620 when it is exposed to the stream of output fluid, thereby preventing undesirable vibration or movement of the deflector 2620. While this is the preferred embodiment, the invention is not limited to this particular configuration, and may include other deflector support members.

Figure 32:
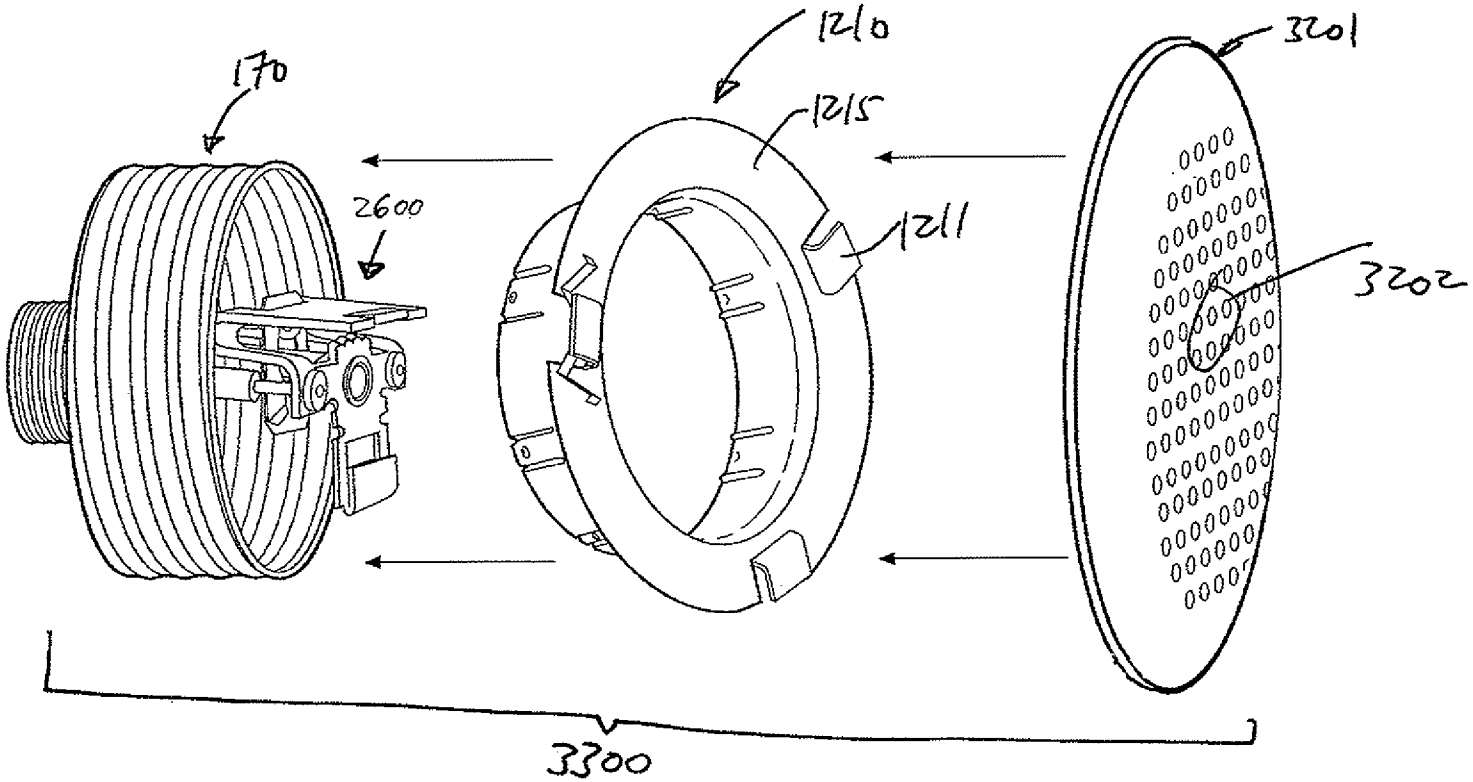
FIG. 32 is a perspective exploded view of the horizontal sidewall sprinkler installed in a support cup/escutcheon/cover assembly of a concealed configuration.
Figure 33:
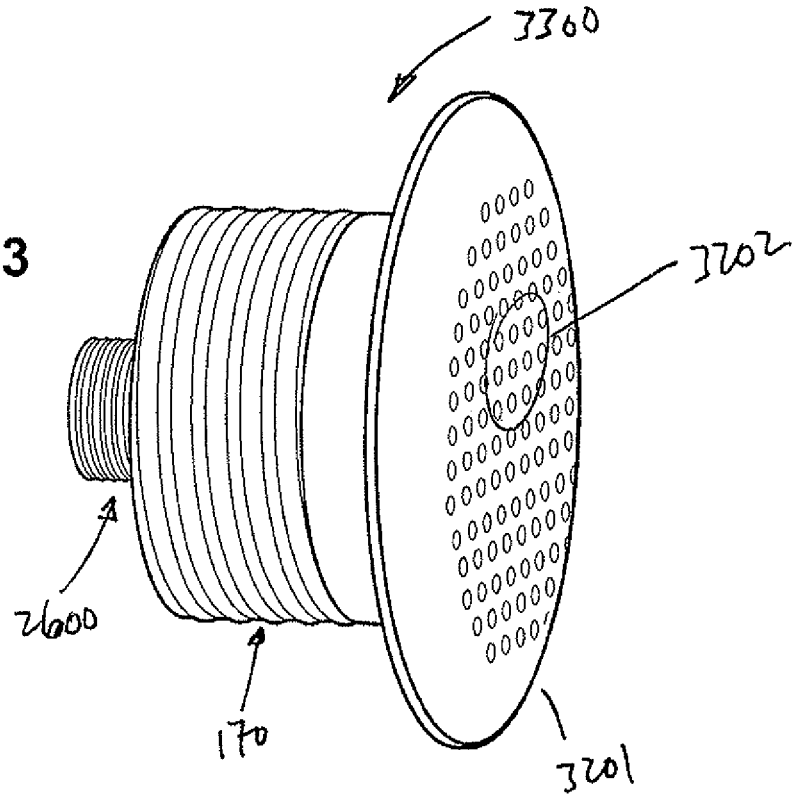
FIG. 33 shows the horizontal sidewall sprinkler and support cup of FIG. 32 with the cover assembly installed.

As shown in FIGS. 26 and 32, the sprinkler 2600 installs within a support cup 170, escutcheon 1210, and cover 3201 assembly to form a concealed sprinkler assembly 3300 shown assembled in FIG. 33. The support cup 170 and the escutcheon 1210 correspond to those structures shown in FIGS. 12 and 13. The cover 3201 includes a plurality of through holes 3202 through which air can pass. Of course, in other embodiments, the cover 3201 is formed without the holes 3202. Such a cover configuration is particularly desirable for residential applications due to its low profile and aesthetically pleasing appearance. The escutcheon 1210 is generally cylindrical and has a circumferential flange 1215 on its outwardly facing end, and installs with a press or threaded fit into the ridged outer surface (walls 175) of the support cup 170. The escutcheon 1210 is formed of metal, e.g., copper alloy.

The flat, circular cover 3201, can also be formed of metal, e.g., brass, or plastic, and the cover 3201 is mounted on raised portions 1211 around the periphery of the escutcheon flange 1215 (see FIG. 32). The cover 3201 attaches to these raised portions 1211 with solder that is designed to melt at a predetermined temperature, e.g., 135° F., to allow for release of the cover 3201. The raised portions 1211 result in a gap 3420 (FIG. 34) between the cover 3201 and the escutcheon 1210, which also allows air flow to reach the sprinkler 2600. The release of the cover 3201 allows the deflector 2620 to move horizontally in the output direction into the deployed position (FIG. 31) when a second predetermined temperature, e.g., 165° F., is reached and the fusible soldered link 320 separates, as described above, to initiate the flow of fluid from the sprinkler to the deflector 2620.

Figure 34:
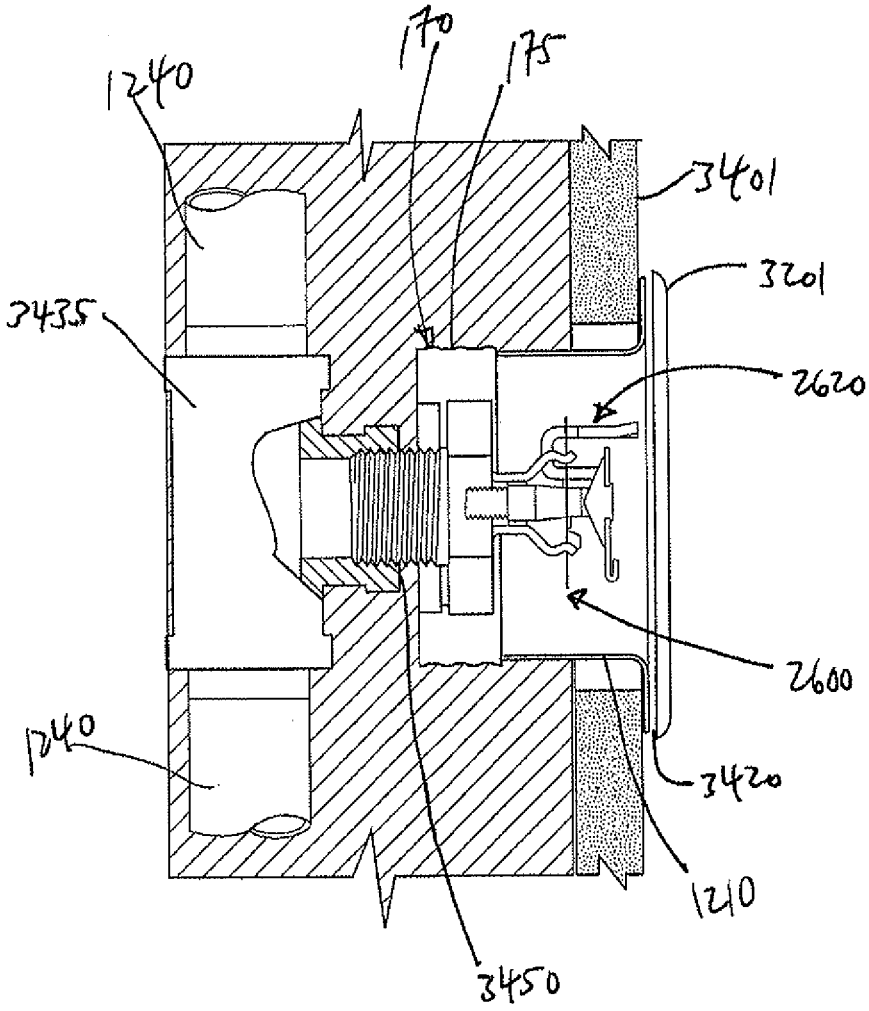
FIG. 34 is a sectional view of the sprinkler of FIG. 26 installed in a wall.

The sprinkler 2600 is installed into the support cup 170 in the same fashion as described above with respect to the sprinkler shown in FIG. 1. However, in the case of the horizontal sidewall concealed sprinkler assembly 3300, the escutcheon 1210 and cover 3201 assembly is installed in the support cup 170 so that the escutcheon flange 1215 rests on the outer surface of the wall 3401 as shown in FIG. 34 (the outer surface of the cover 3201 is about 3/16 inch from the surface of the wall due to the gap 3420 between the flange 1215 and cover 3201).

The support cup 170 and escutcheon 1210 are configured to allow for an adjustment to accommodate variations in the distance between the face 3450 of the conduit output fitting 3435 and the surface of the wall 3401, which is referred to as the "field adjustment." The field adjustment is sometimes needed, because the deflector 2620 must be properly located away from the surface of the wall 3401 in its deployed position (e.g., FIGS. 26 and 31), but it is difficult to precisely position sprinkler conduits 1240 with respect to the wall 3401 surface, due to the practicalities of building construction. To ensure the correct position of the deployed deflector 2620, the distance between the face 3450 of the conduit output fitting 3435 and the wall 3401 should not be more than 2 inches.

The field adjustment is achieved by allowing the escutcheon 1210 to be positioned with a varying degree of overlap with the outer walls 175 of the support cup 170. The support cup 170 and escutcheon 1210 are configured so that any secure engagement between these components results in a proper position for the deployed deflector 2620.

The amount of field adjustment, which in this example is between 5/16 to 3/8 inch, is determined by the length of the rods 165 of the deflector support members 150, because the length of the rods 165 determines the amount of variation that can be accommodated in the position of the conduit 1240 relative to the wall surface 3401. In other words, the rods 165 may be completely retracted within the housing member 155 before deployment, such as when the conduit 1240 and, therefore the sprinkler 2600, is positioned as close as possible to the wall surface 3401. Alternatively, the rods 165 may be nearly 3/4 extended before deployment, such as when the conduit 1240 is positioned as far as possible away from the wall surface 3401. The length of the rods 165, in turn, determines the height of the outer walls 175 of the support cup 170. Thus, the outer walls 175 of the support cup 170 must have a height of slightly more than 5/16 to 3/8 inch in the example described herein. While these dimensions are present in this embodiment, it is within the reach of ordinary skill to make a sprinkler that would operate satisfactorily with values that depart somewhat from these, and to make a sprinkler that would be operable without using these exemplary values.

Configuring the deflector support members 150 such that the rods 165 extend through the housing members 155, and the flange 140 allows for the use of a shallower cup 170, because the depth of the support cup 170 is primarily determined by the length of the rods 165. This in turn results in the fusible soldered link 320 (e.g., FIG. 30) being located closer to the surface of the wall 3401, thereby improving sprinkler sensitivity.

It is expected that the horizontal sidewall concealed fire sprinkler complies with the distribution requirements of Underwriter Laboratory's (UL) Residential Wall Wetting/Floor Wetting criteria for any given coverage area, but is at least believed to achieve water distribution of 18 feet by 18 feet on the floor below the sprinkler, when installed in accordance with that UL requirement.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

Therefore, while the invention has been shown and described with respect to example embodiments thereof, it will be understood by those skilled in the art that changes in form and details may be made to these embodiments without departing from the scope and spirit of the invention.

What is claimed is:

1. A horizontal sidewall sprinkler including:

a body having an output orifice and a flange, the body having an axis in an output direction, wherein the body is constructed to be fluidly coupled in a wall to a fluid supply;

a seal cap to seal a flow of fluid from the output orifice;

a thermally-responsive element positioned to releasably retain the seal cap at a first predetermined temperature;

a plurality of housing members extending from the flange;

a plurality of rods, each rod slidably contained within one of the housing members and extending into the flange; and a deflector connected to ends of the rods, the deflector comprised of a first surface extending in a direction transverse to the rods and a second surface connected to the first surface, the second surface extending in a direction parallel to a plane passing through the rods, wherein a majority of the second surface is rearwardly positioned with respect to the first surface, wherein each of the rods comprises at least one cylindrical portion and at least one frustoconical portion, and each of the housing members comprises at least one cylindrical portion and at least one frustoconical portion, and wherein at least one frustoconical portion of the rod lodges in at least one frustoconical portion of the housing member, and wherein the second surface of the deflector extends beyond the first surface in the output direction a predetermined distance, wherein when the sprinkler is fluidly coupled, the thermally-responsive element and the deflector are recessed completely behind the surface of the wall.

2. The horizontal sidewall sprinkler of claim 1, wherein the first surface has a substantially vertical face that is transverse to a direction of fluid flow from the output orifice, and the second surface has a substantially horizontal shelf positioned above and substantially perpendicular to the vertical face, wherein a portion of the horizontal shelf extends in the direction of fluid flow by a first length, with respect to the vertical face, and the first length is less than about half of a total length of the horizontal shelf in the fluid flow direction.

3. The horizontal sidewall sprinkler of claim 1, further including:

a support cup configured to support the fire protection sprinkler; and an escutcheon removably attached to the support cup, the escutcheon having an annular flange.

4. The horizontal sidewall sprinkler of claim 3, further including a substantially planar cover removably attached to the annular flange of the escutcheon, wherein the cover is configured to detach from the escutcheon at a second predetermined temperature that is less than or equal to the first predetermined temperature.

5. The horizontal sidewall sprinkler of claim 4, wherein the cover includes a plurality of through openings.

6. A horizontal sidewall fire protection sprinkler, comprising:

a body having an output orifice and a flange, wherein the body is constructed for fluid coupling in a wall to a fluid supply;

a seal cap to seal a flow of fluid from the output orifice;

a thermally-responsive element positioned to releasably retain the seal cap;

a plurality of deflector support members extending from the flange; and a deflector connected to the deflector support members, the deflector including a shelf that extends in the output direction and a vertical face that extends transverse to the shelf, wherein a majority of the shelf is rearwardly positioned with respect to the vertical face, wherein the deflector support members lie in plane that is substantially parallel to the shelf, and wherein the shelf of the deflector extends beyond the vertical face in the output direction a predetermined distance, wherein when the sprinkler is fluidly coupled, the thermally-responsive element and the deflector are recessed completely behind the surface of the wall.

7. The horizontal sidewall sprinkler of claim 6, wherein the deflector support members extend at least through the flange.

8. A horizontal sidewall fire protection sprinkler, comprising:

a body having an output orifice and a flange, wherein the body is constructed to be fluidly coupled within a wall to a fluid supply;

a seal cap to seal a flow of fluid from the output orifice;

a thermally-responsive element positioned to releasably retain the seal cap;

a plurality of deflector support members having movable portions configured to move from a first position to a second position; and a deflector connected to the movable portions of the deflector support members, the deflector including a shelf extending in the output direction and a vertical face that extends transverse to the shelf, wherein a majority of the shelf is rearwardly positioned with respect to the vertical face, wherein the deflector support members lie in plane that is substantially parallel to the shelf, wherein, in the first position, the movable portions of the deflector support members are within the flange, and in the second position the movable portions of the deflector support members are in a second position that is farther away from the flange in the output direction, and wherein the shelf of the deflector extends beyond the vertical face in the output direction a predetermined distance, wherein when the sprinkler is fluidly coupled, the thermally-responsive element and the deflector are recessed completely behind the surface of the wall.

9. A horizontal sidewall fire protection sprinkler, comprising:

a body having an output orifice and a flange, wherein the body is constructed to be fluidly coupled in a wall to a fluid supply;

a seal cap to seal a flow of fluid from the output orifice;

a thermally-responsive element positioned to releasably retain the seal cap;

a plurality of housing members extending from the flange;

a plurality of rods, each rod slidably contained within one of the housing members and extending into the flange;

a deflector connected to ends of the rods, the deflector including a shelf extending in the output direction and a vertical face that extends transverse to the shelf, wherein a majority of the shelf is rearwardly positioned with respect to the vertical face, wherein the housing members and the rods lie in a plane that is substantially parallel to the shelf;

a support cup having a substantially cylindrical outer surface, wherein the sprinkler is mounted in the support cup, wherein a height of the outer surface of the support cup in an axial direction is less than a length of the rods, and wherein the shelf of the deflector extends beyond the vertical face in the output direction a predetermined distance, wherein when the sprinkler is fluidly coupled, the thermally-responsive element and the deflector are recessed completely behind the surface of the wall.

10. The horizontal sidewall sprinkler of claim 9, wherein the thermally-responsive element comprises a pair of levers, each of which is connected to a soldered link.

11. The horizontal sidewall sprinkler of claim 9, wherein each of the rods slides between a first position within the housing member to a second position extending from the housing member in the output direction parallel to the shelf.

12. The horizontal sidewall sprinkler of claim 11, wherein, in the second position, the rods engage the housing members so as to assist in maintaining the deflector in a relatively stable position.

13. The horizontal sidewall sprinkler of claim 9, wherein each of the rods comprises at least one cylindrical portion and at least one frustoconical portion.

14. The horizontal sidewall sprinkler of claim 13, wherein each of the housing members comprises at least one cylindrical portion and at least one frustoconical portion, and at least one frustoconical portion of the rod lodges in at least one frustoconical portion of the housing member.

15. The horizontal sidewall sprinkler of claim 9, wherein the deflector comprises a conical portion facing the output orifice.

16. The horizontal sidewall sprinkler of claim 9, wherein the deflector comprises at least one radial slot.

17. The horizontal sidewall sprinkler of claim 9, wherein at least two sides of the deflector are substantially linear.

18. The horizontal sidewall sprinkler of claim 9, wherein the deflector comprises tab portions configured to connect to ends of the rods, wherein the tab portions extend in a plane transverse to the shelf.

19. The horizontal sidewall sprinkler of claim 9, further comprising:

a substantially cylindrical escutcheon installed in the support cup so as to surround the sprinkler, the escutcheon having a flange; and a substantially flat cover releasably mounted on the flange of the escutcheon, wherein the deflector moves from a first position to a second position upon release of the cover, wherein the second position is farther in the output direction than the first position.

20. The horizontal sprinkler of claim 4, wherein the cover is constructed to be coplanar to the wall when the sprinkler is fluidly coupled.

* * * * *